US008550761B2

(12) United States Patent
Belik et al.

(10) Patent No.: US 8,550,761 B2
(45) Date of Patent: Oct. 8, 2013

(54) DRILL PIPE HANDLING AND MOVING SYSTEM

(75) Inventors: Jaroslav Belik, Pearland, TX (US); Richard D. Souchek, Richmond, TX (US)

(73) Assignee: National Oilwell Varco, L.P., Houston, TX (US)

( * ) Notice: Subject to any disclaimer, the term of this patent is extended or adjusted under 35 U.S.C. 154(b) by 0 days.

(21) Appl. No.: 12/966,828

(22) Filed: Dec. 13, 2010

(65) Prior Publication Data

US 2011/0079434 A1 Apr. 7, 2011

Related U.S. Application Data

(63) Continuation of application No. 11/970,900, filed on Jan. 8, 2008, now abandoned.

(60) Provisional application No. 60/879,161, filed on Jan. 8, 2007.

(51) Int. Cl.
*E21B 19/14* (2006.01)

(52) U.S. Cl.
USPC ..... 414/22.63

(58) Field of Classification Search
USPC ..... 211/70.4; 414/22.63, 22.65, 22.68, 414/22.71, 279, 280, 282, 284, 400
See application file for complete search history.

(56) References Cited

U.S. PATENT DOCUMENTS 2,290,247 A * 7/1942 Perkins, Jr. ..... 414/22.63
2,535,546 A 12/1950 Pitts
2,615,681 A * 10/1952 True ..... 166/77.51
2,773,605 A 12/1953 Jarnett
3,105,596 A * 10/1963 Gagnon et al. ..... 212/319
3,212,654 A * 10/1965 Dolphin ..... 414/341
3,633,767 A * 1/1972 Mitchell et al. ..... 414/22.68
3,747,192 A 7/1973 Harris et al.
3,921,823 A * 11/1975 Bourree et al. ..... 414/22.64
4,193,731 A * 3/1980 Blatt et al. ..... 414/589

(Continued)

FOREIGN PATENT DOCUMENTS

EP 0234880 A2 9/1987
JP 05195683 A * 8/1993
WO 2006075914 A1 7/2006

OTHER PUBLICATIONS

EPO Search Report dated Jul. 3, 2008 for EP Application No. 08100044.0.

(Continued)

*Primary Examiner* — Gregory Adams
(74) *Attorney, Agent, or Firm* — Conley Rose, P.C.

(57) ABSTRACT

A pipe handling system includes a frame removably coupled to a drilling mast, a gripping arm moveably coupled to the frame, and a grip jaw extending from the gripping arm to engage a drill pipe, wherein the gripping arm and the grip jaw are operable to move a drill pipe from within the drilling mast to a pipe storage area adjacent the drilling mast. Other embodiments include a pipe racker and a setback handling system disposed below the pipe racker to engage a lower end of the drill pipe, the setback handling system including a moveable pipe guide and a rotating table supporting the pipe guide. In some embodiments, the rotating table also supports a pipe mover for moving the drill pipe to desired storage positions in a setback rack. Pipe handling methods are also disclosed.

15 Claims, 40 Drawing Sheets

(56) References Cited

U.S. PATENT DOCUMENTS

| | | | | |
|---|---|---|---|---|
| 4,397,605 | A | 8/1983 | Cowgill | |
| 4,428,710 | A * | 1/1984 | Grisebach et al. | 414/590 |
| 4,462,733 | A * | 7/1984 | Langowski et al. | 414/22.71 |
| 4,531,875 | A * | 7/1985 | Krueger | 414/22.68 |
| 4,715,761 | A | 12/1987 | Berry et al. | |
| 4,738,321 | A | 4/1988 | Olivier | |
| 4,765,401 | A | 8/1988 | Boyadjieff | |
| 2004/0057815 | A1 * | 3/2004 | Woolslayer et al. | 414/22.63 |
| 2005/0118003 | A1 * | 6/2005 | Mitchell et al. | 414/284 |
| 2011/0079434 | A1 * | 4/2011 | Belik et al. | 175/57 |

OTHER PUBLICATIONS

Office Action dated Mar. 25, 2010 for U.S. Appl. No. 11/970,900.

Amendment and Response to Office Action dated Mar. 25, 2010 for U.S. Appl. No. 11/970,900, filed Apr. 26, 2010.

Office Action dated Jun. 1, 2010 for U.S. Appl. No. 11/970,900.

Amendment and Response to Office Action dated Jun. 1, 2010 for U.S. Appl. No. 11/970,900, filed Sep. 1, 2010.

Final Office Action dated Sep. 13, 2010 for U.S. Appl. No. 11/970,900.

* cited by examiner

DRILL PIPE HANDLING AND MOVING SYSTEM

CROSS-REFERENCE TO RELATED APPLICATIONS

The present application is a continuation of U.S. patent application Ser. No. 11/970,900, filed Jan. 8, 2008, now abandoned, entitled "Drill Pipe Handling and Moving System", which claims the benefit of U.S. Provisional Application Ser. No. 60/879,161, filed Jan. 8, 2007, entitled Mast-Mounted Pipe Racking System.

BACKGROUND

Drilling masts are the vertical structures used to support the drill string while a well is being drilled. Masts are usually rectangular in shape as opposed to the generally pyramidal shape of a derrick. The rectangular shape offers very good stiffness that allows the mast to be moved to a horizontal position for transport. Thus, drilling masts are very common on portable land rigs.

Drilling masts also often have relatively compact footprints, which often limit space available for the vertical storage of pipe. A storage area for vertical pipe is often provided immediately adjacent to the drilling mast. As a stand of drill pipe is removed from the well it is manually guided from the wellbore to the storage area where it is captured at its upper end by a fingerboard and its lower end rests at or near the drill floor. The movement of the drill pipe to the fingerboard is often effectuated by rig personnel pulling or pushing the drill pipe to its proper location. Such movements of large sections of drill pipe can be hazardous to the rig personnel, both near the drilling mast's fingerboard and below at the drill floor.

Thus, there remains a need to develop methods and apparatus for pipe handling and drilling systems, which overcome some of the foregoing difficulties while providing more advantageous overall results. For example, automating pipe handling procedures can eliminate personnel from the drilling mast at the pipe racker and from the drill floor at the setback handler, thereby alleviating safety concerns. Also, removably coupling pipe handling components to the drilling mast can ease constraints on the limited drilling mast footprint.

BRIEF DESCRIPTION OF THE DRAWINGS

For a more detailed description of embodiment of the present invention, reference will now be made to the accompanying drawings, wherein.

DETAILED DESCRIPTION

Figure 1:
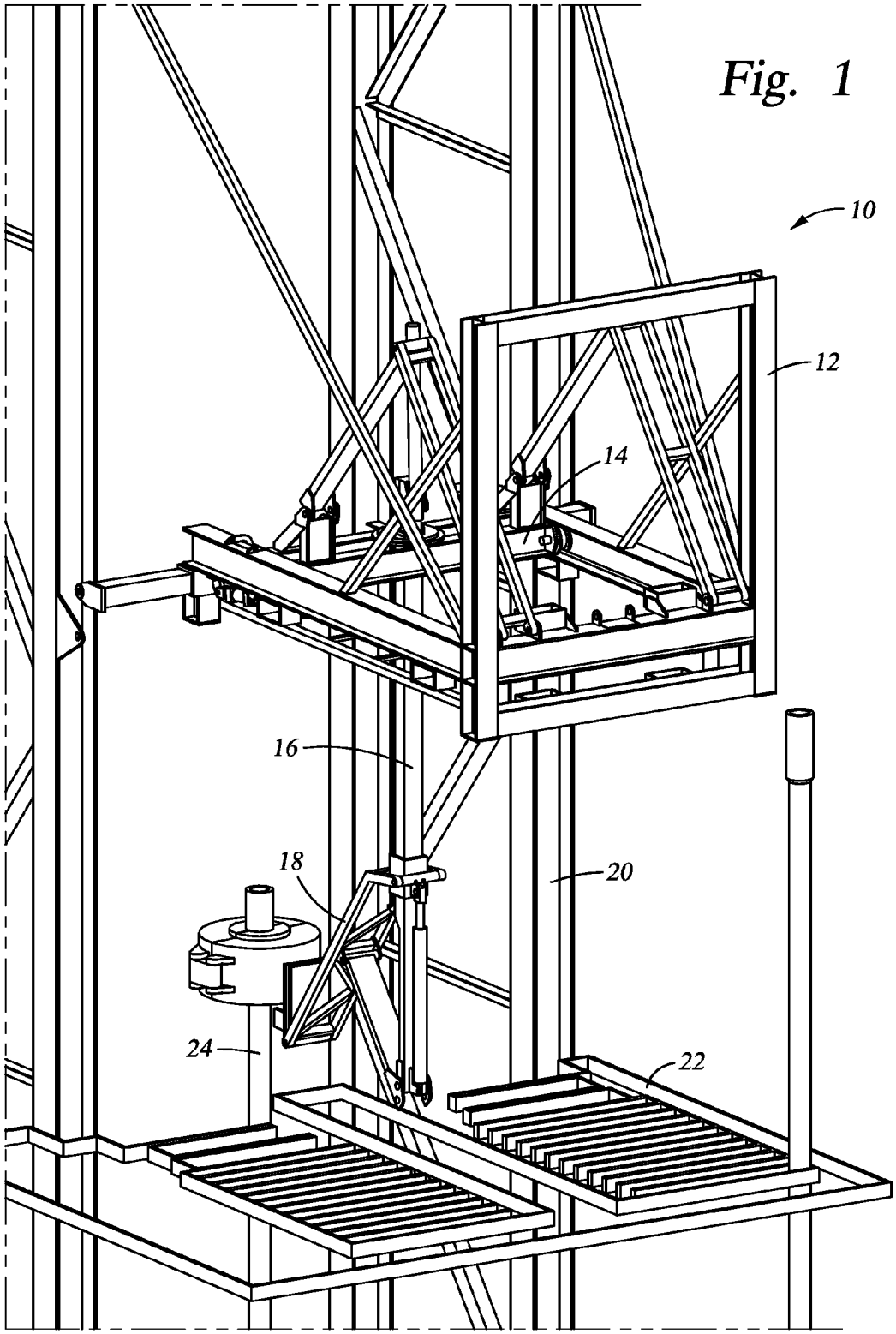
FIGS. 1-10 illustrate side elevation views of a pipe racking system constructed in accordance with embodiments of the present invention.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results.

Unless otherwise specified, any use of any form of the terms "connect", "engage", "couple", "attach", or any other term describing an interaction between elements is not meant to limit the interaction to direct interaction between the elements and may also include indirect interaction between the elements described. Reference to the term "drill pipe" includes a variety of oilfield tubulars, including drill pipe, drill collars, casing, and tubing. Reference to the term "drilling mast" may also include other drilling structures extending above a drill floor to support equipment for downhole operations. In the following discussion and in the claims, the terms "including" and "comprising" are used in an open-ended fashion, and thus should be interpreted to mean "including, but not limited to . . . ". The various characteristics mentioned above, as well as other features and characteristics described in more detail below, will be readily apparent to those skilled in the art upon reading the following detailed description of the embodiments, and by referring to the accompanying drawings.

Referring now to FIG. 1, an embodiment of a pipe racking system 10 comprises frame 12, carriage 14, column 16, and gripping arm 18. Racking system 10 is coupled to mast 20 above fingerboard 22. Gripping arm 18 is supported on the lower end of column 16, which extends downward from carriage 14. Carriage 14 is supported by frame 12 and moves column 16 and gripping arm 18 so as to move pipe 24 from well center into fingerboard 22. Column 16 controls the vertical and rotational position of gripping arm 18 so that the gripping arm can engage pipe 24 at the proper height and move the pipe into its proper location within fingerboard 22.

Figure 2:
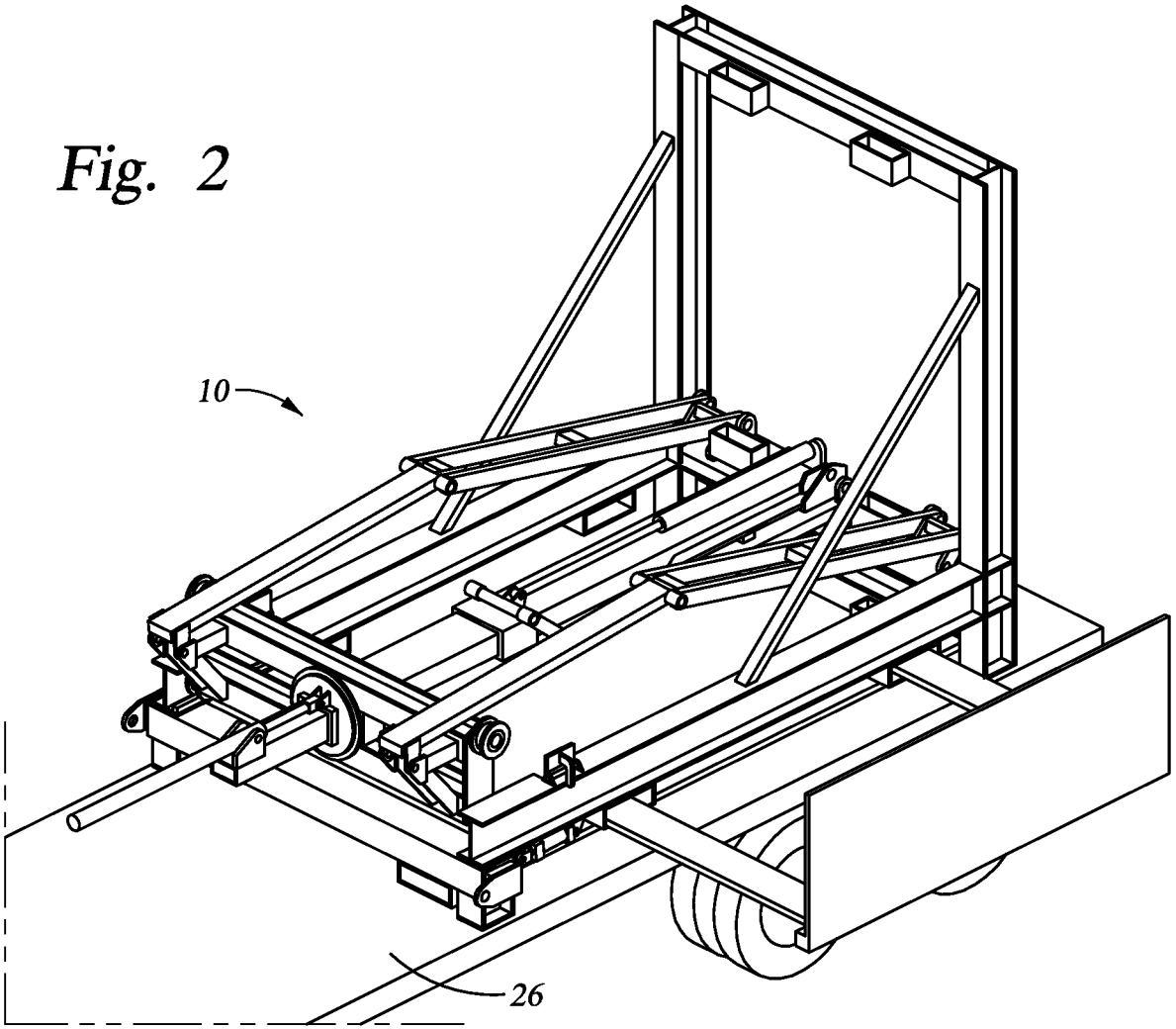
Figure 3:
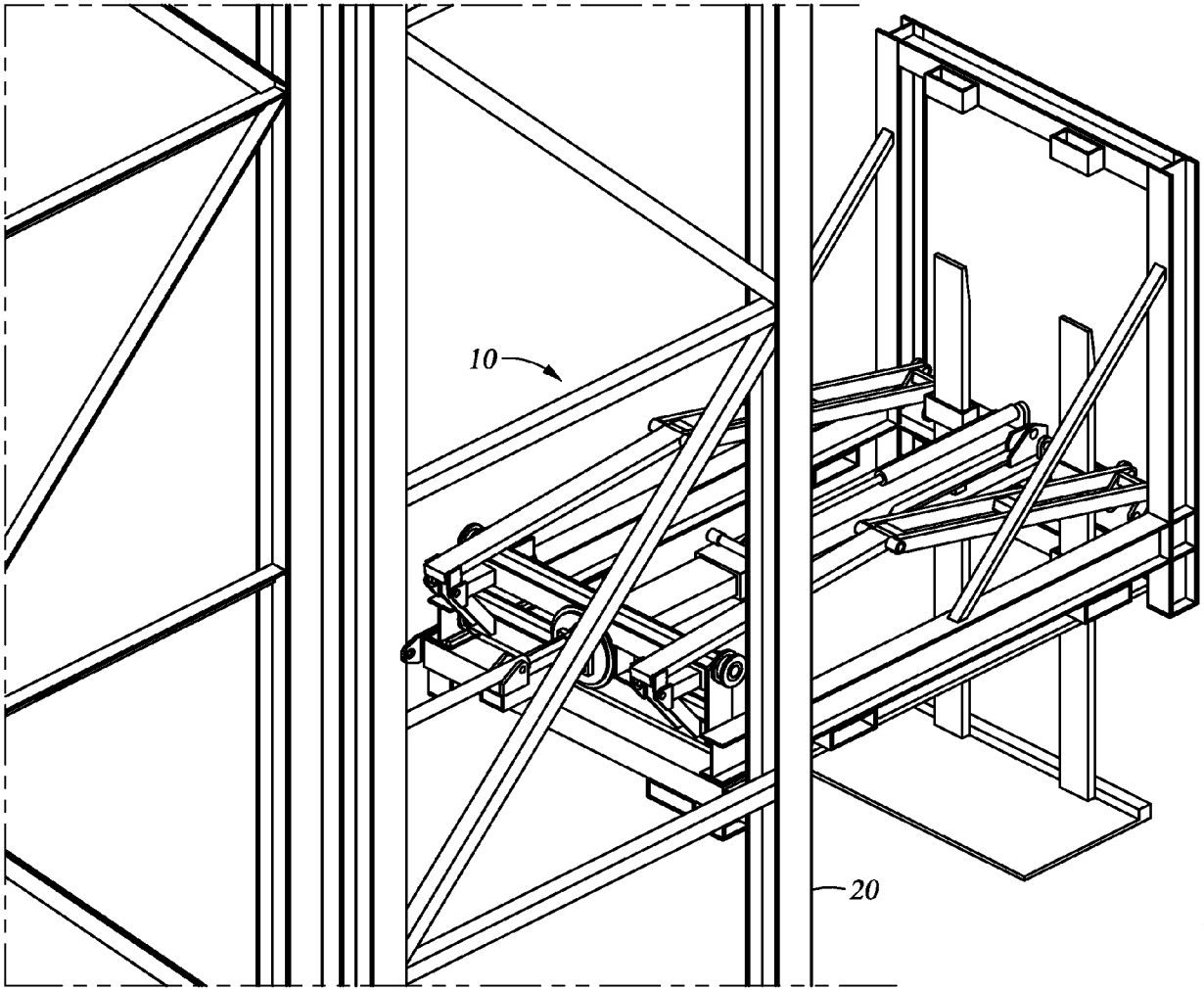
Figure 4:
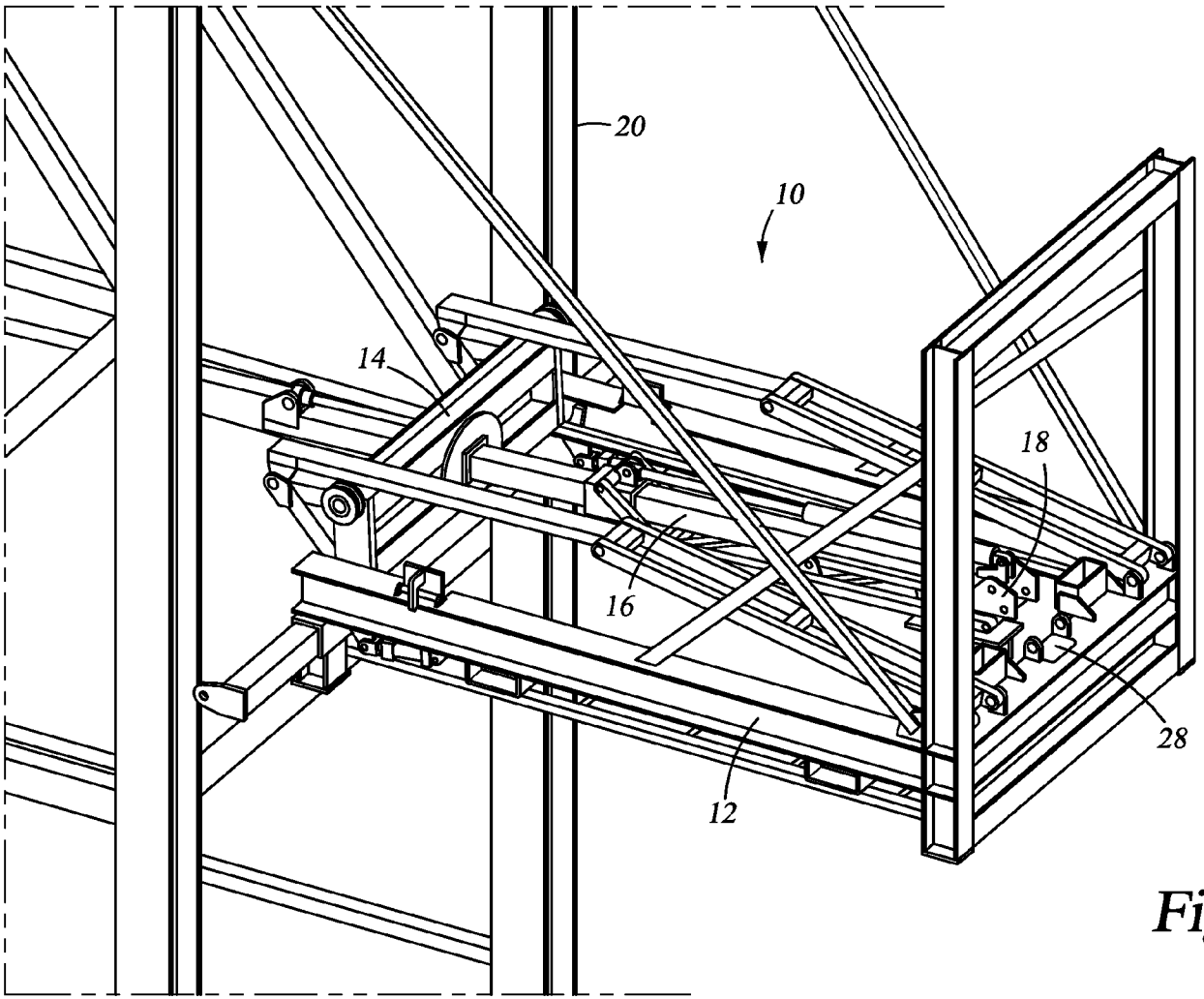
Figure 5:
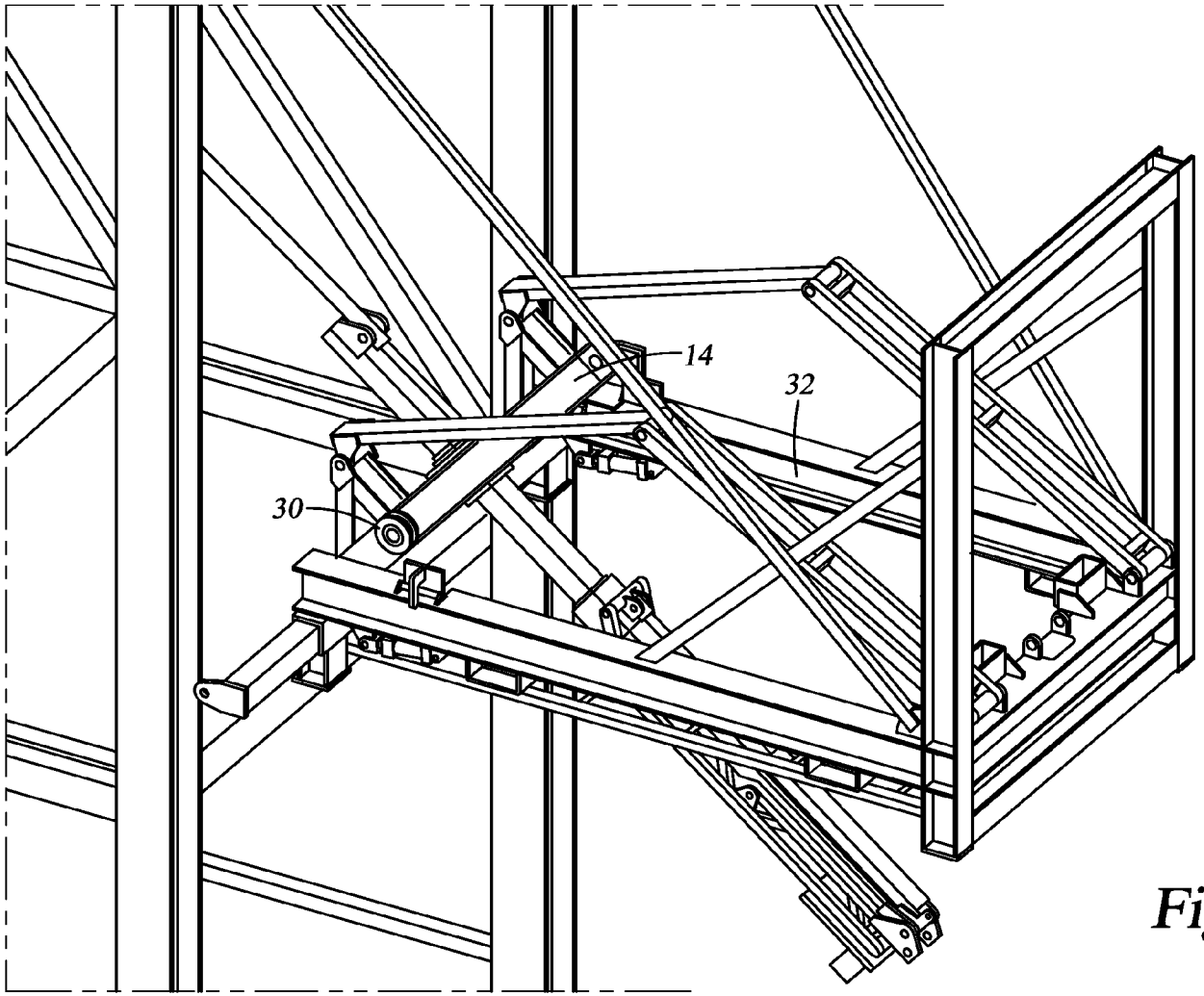
Figure 6:
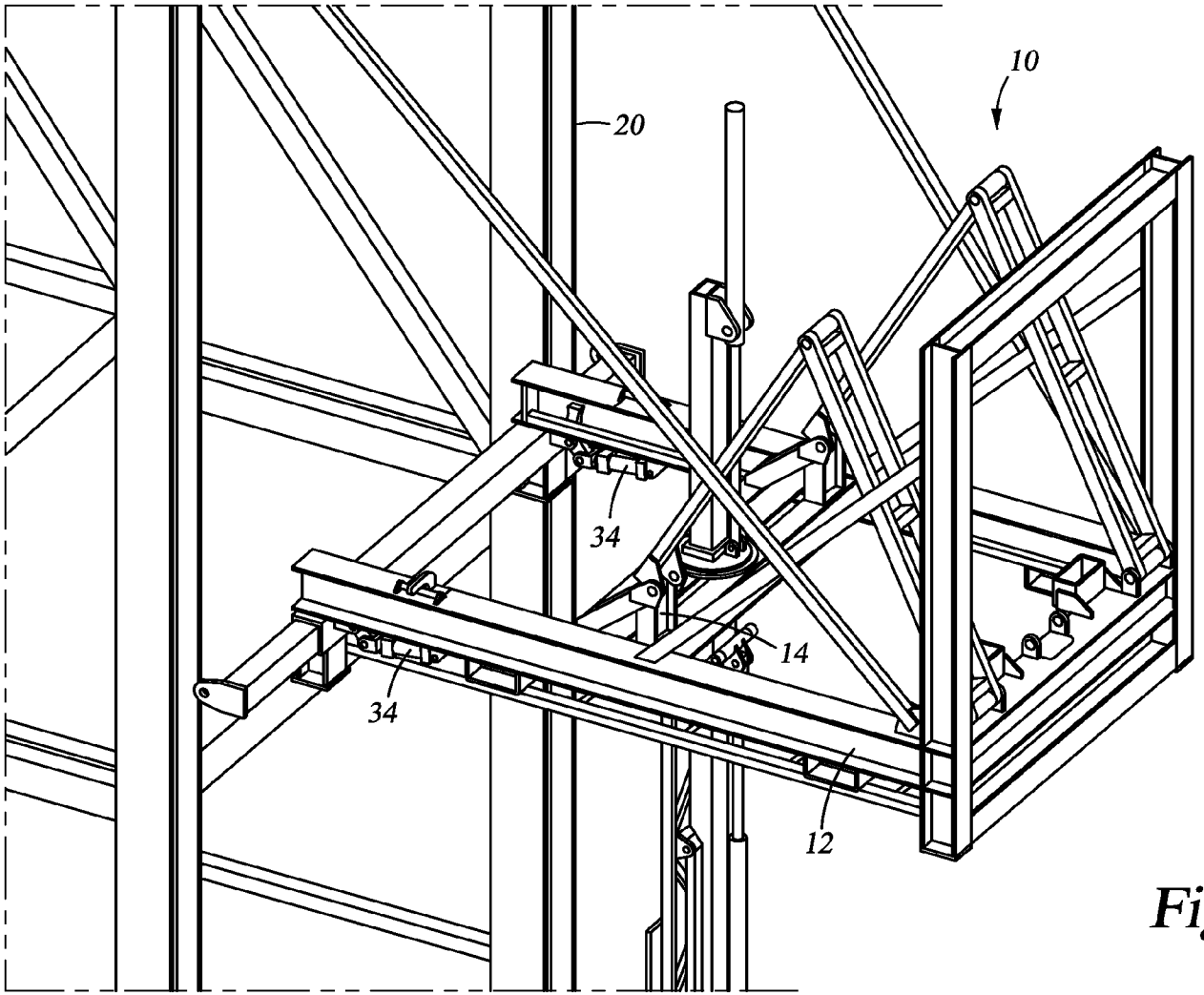

FIGS. 2-6 illustrate the installation of pipe racking system 10 onto mast 20. Referring now to FIG. 2, racking system 10 can be transported to a drilling site on trailer 26. Racking system 10 is unloaded from the trailer, such as by a forklift, and set in an upright position where it can be pinned to mast 20, which is in a horizontal position, as shown in FIG. 3. Referring now to FIG. 4, once mast 20 has been raised to its vertical position, gripping arm 18 is decoupled from its storage lock 28 on frame 12 and raised slightly to clear frame 12. Column 16 is also raised for clearance from frame 12. Carriage 14 is rotated or pivoted until wheels 30 engage track 32 on frame 12, as shown in FIG. 5. Carriage locks 34 are then released to allow carriage 14 to move relative to frame 12, as shown in FIG. 6.

Figure 7:
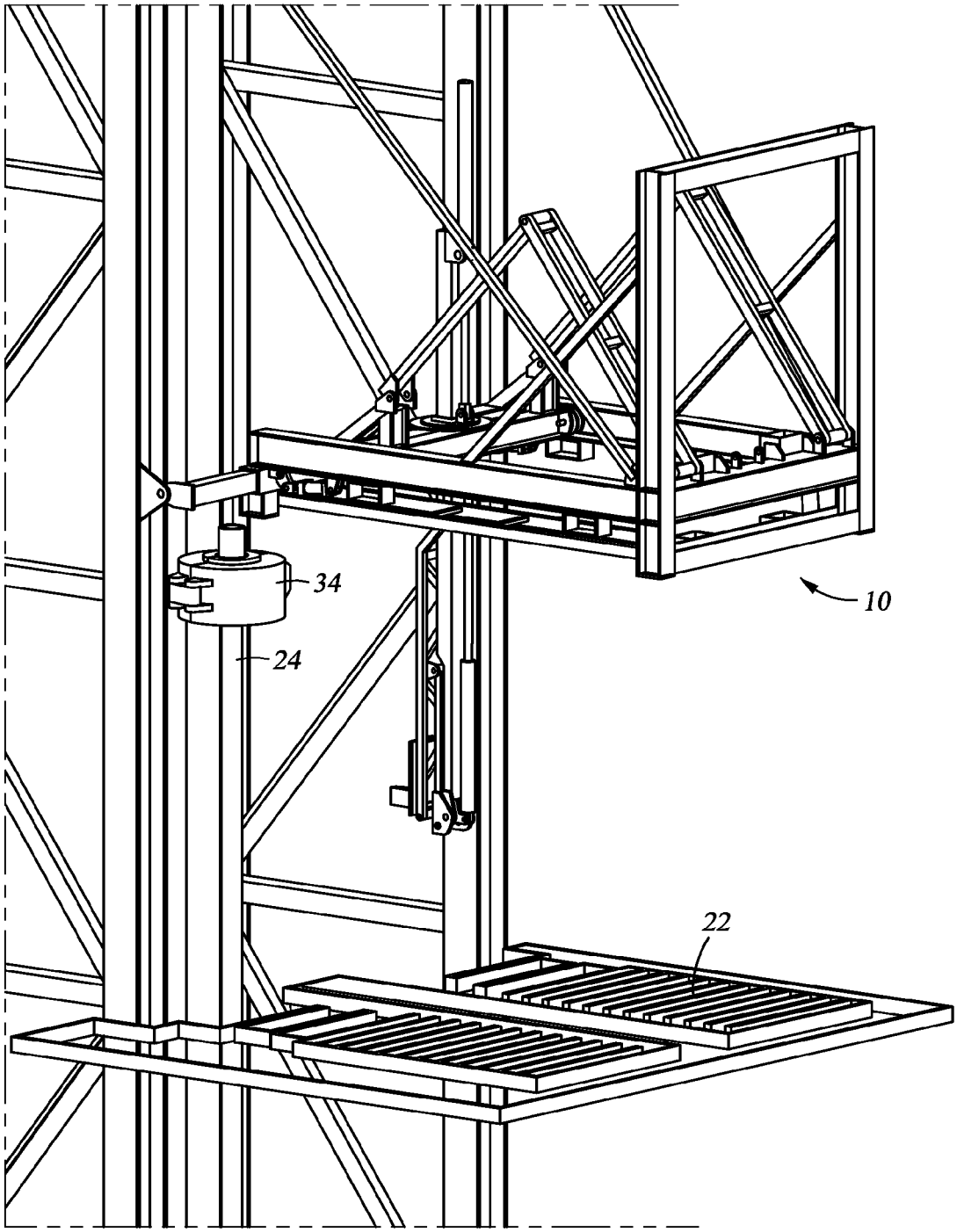
Figure 8:
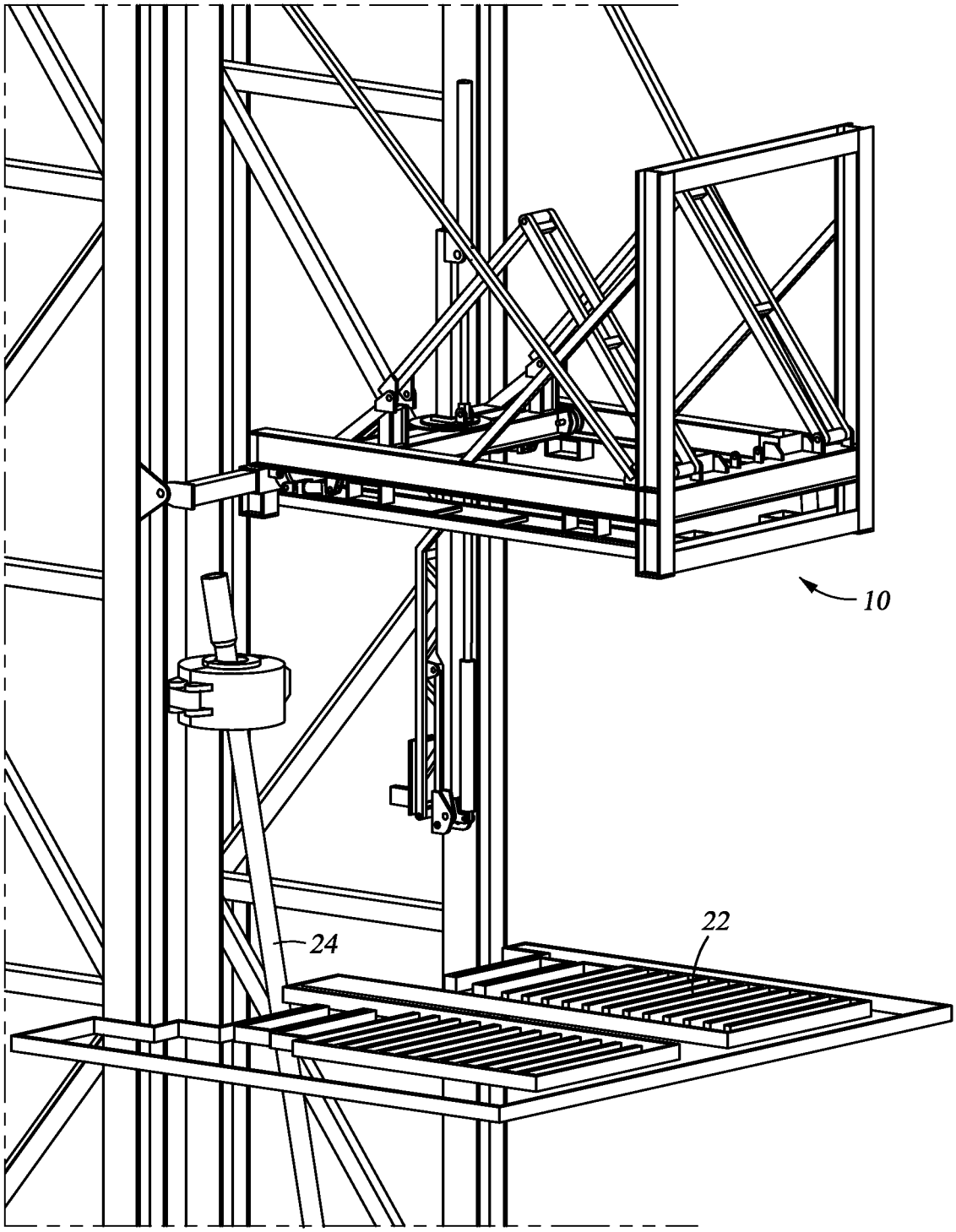
Figure 9:
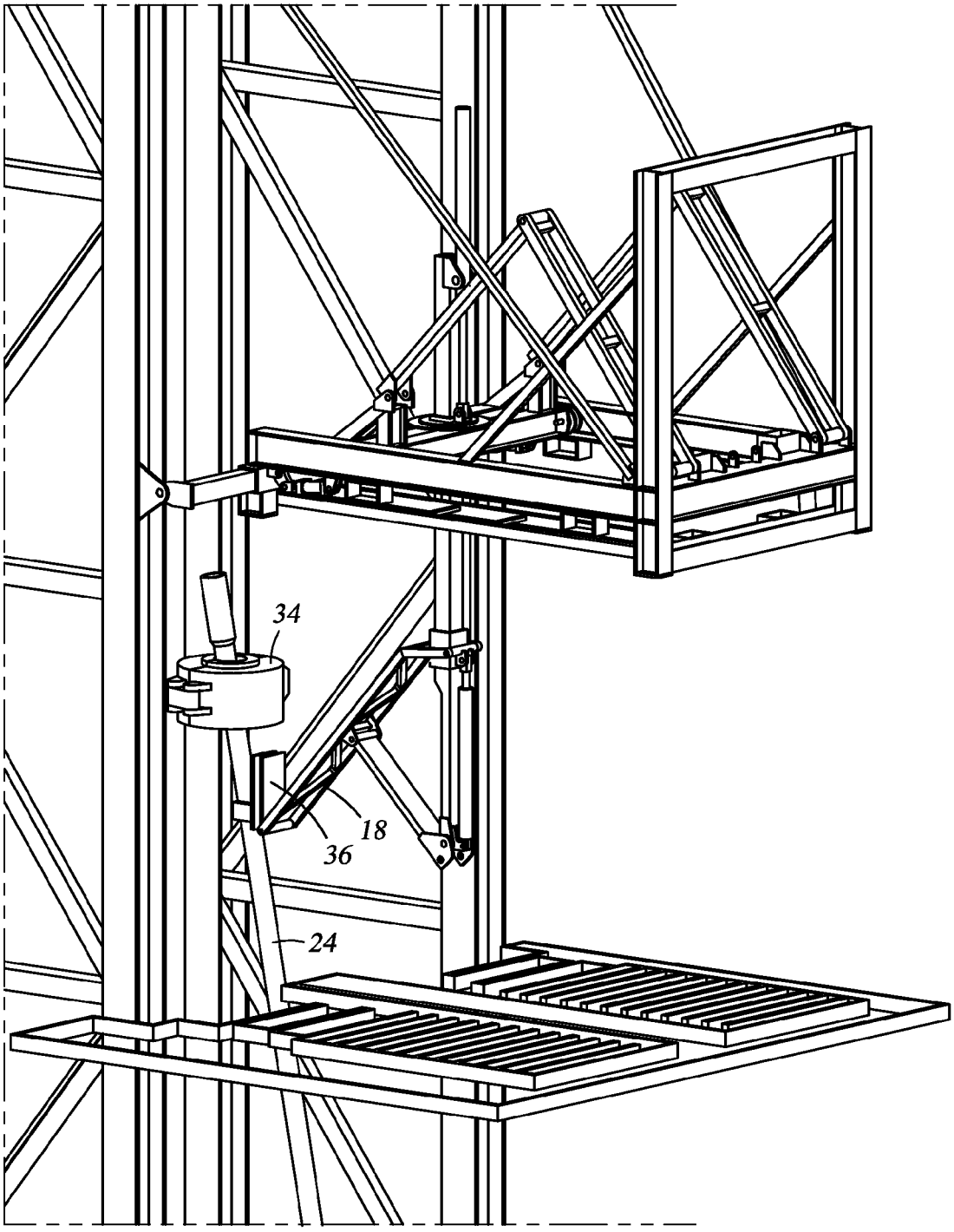
Figure 10:
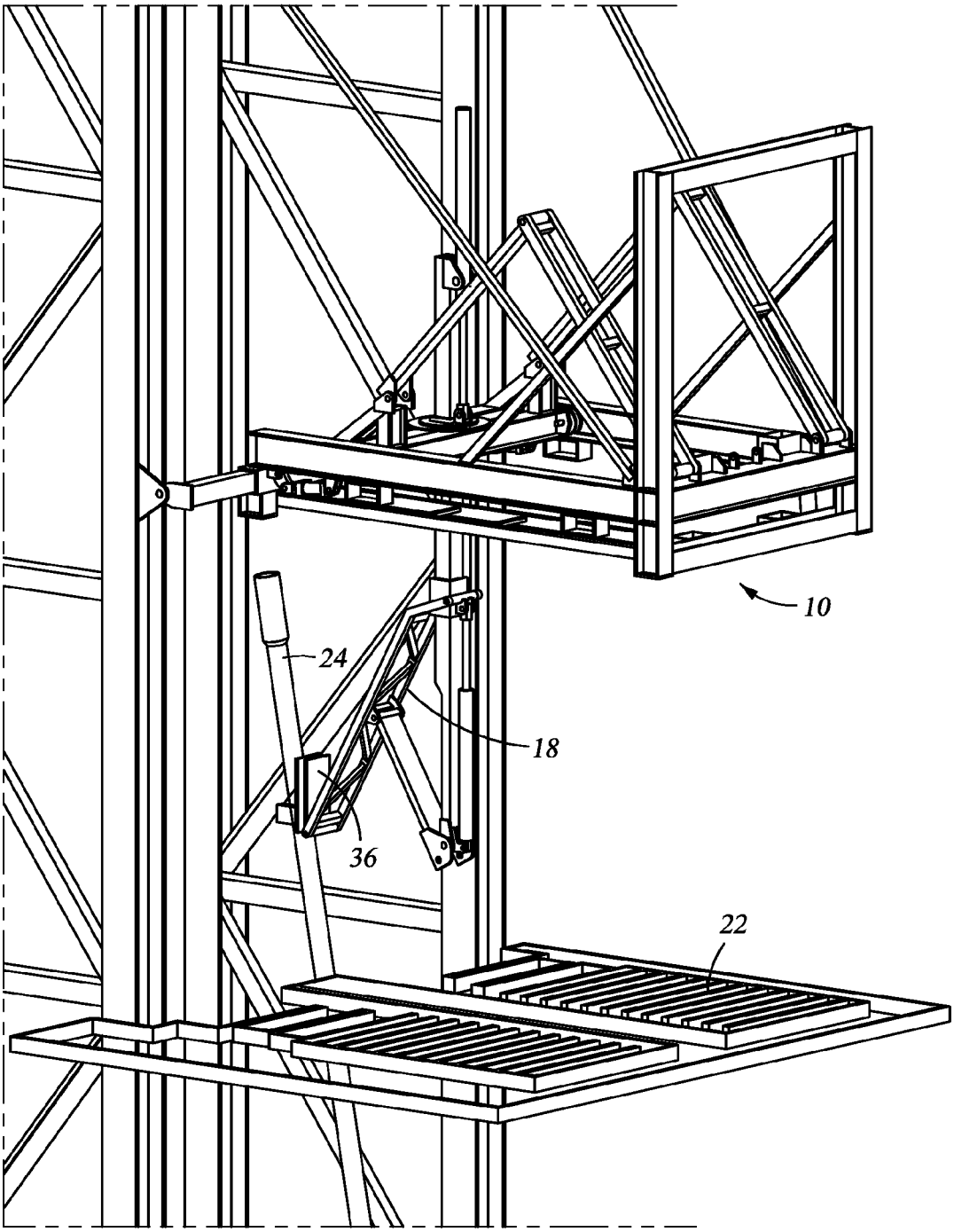
Figure 11:
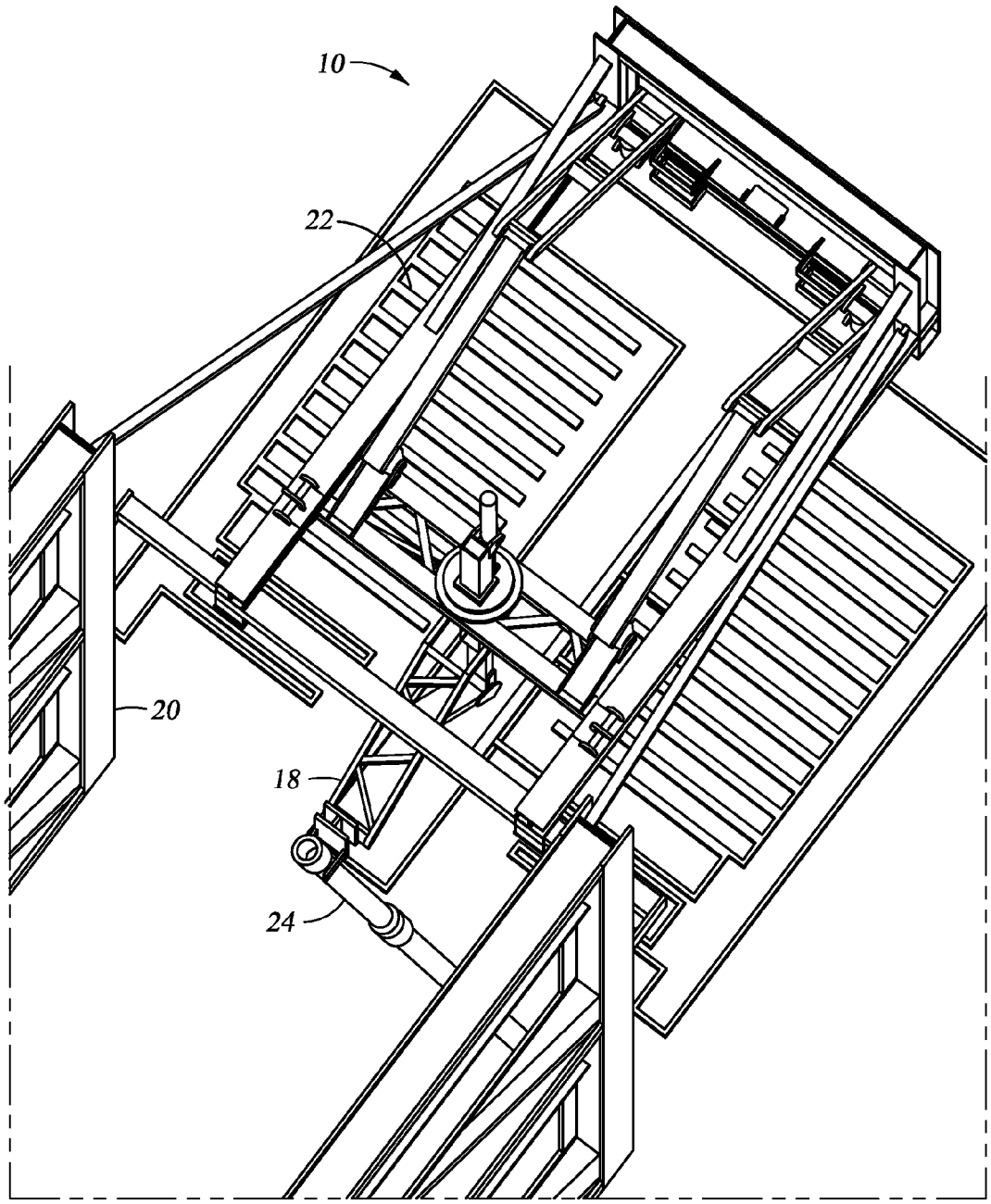
FIGS. 11-15 illustrate top-down views of additional embodiments of the pipe racking system of FIGS. 1-10.
Figure 12:
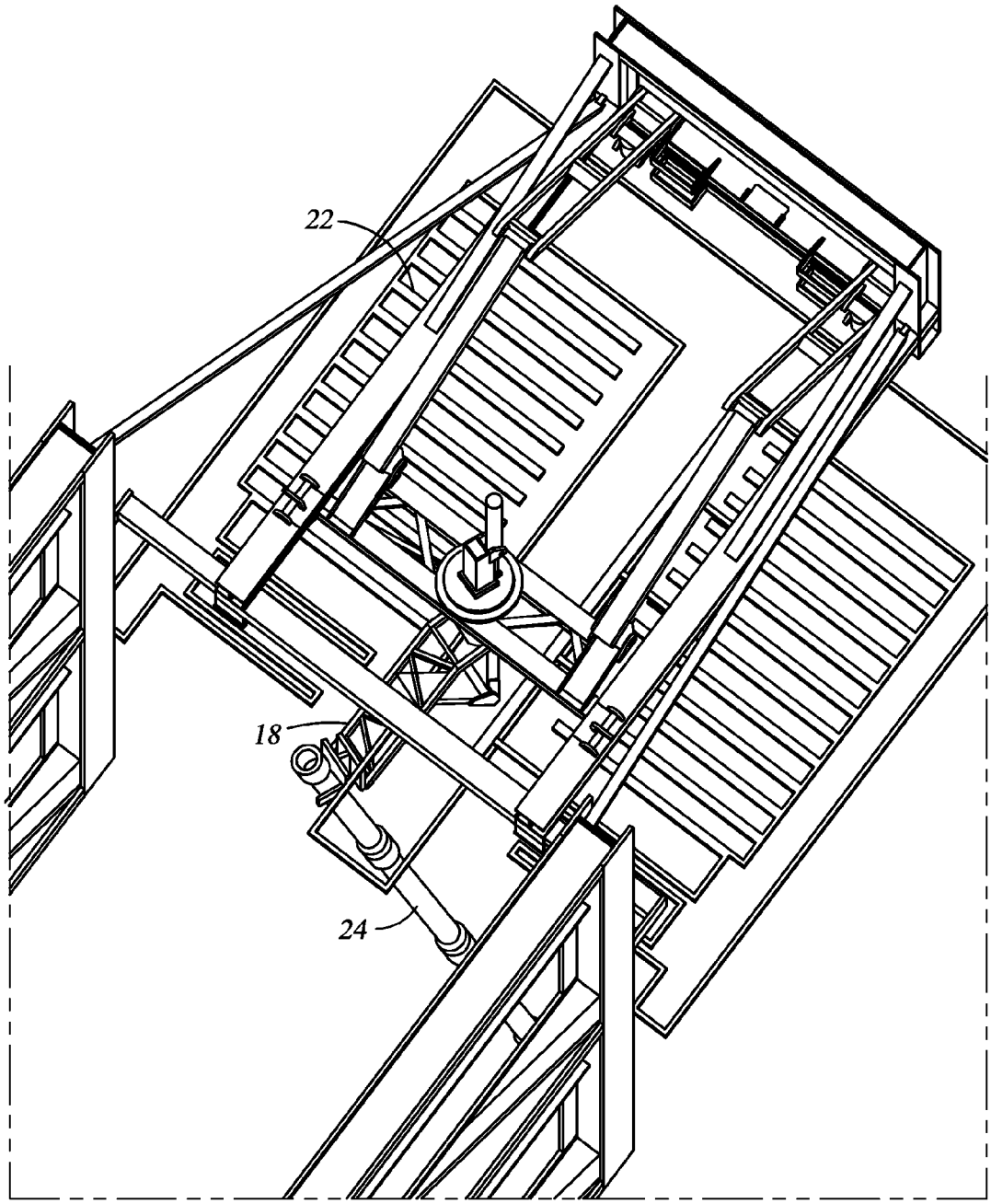
Figure 13:
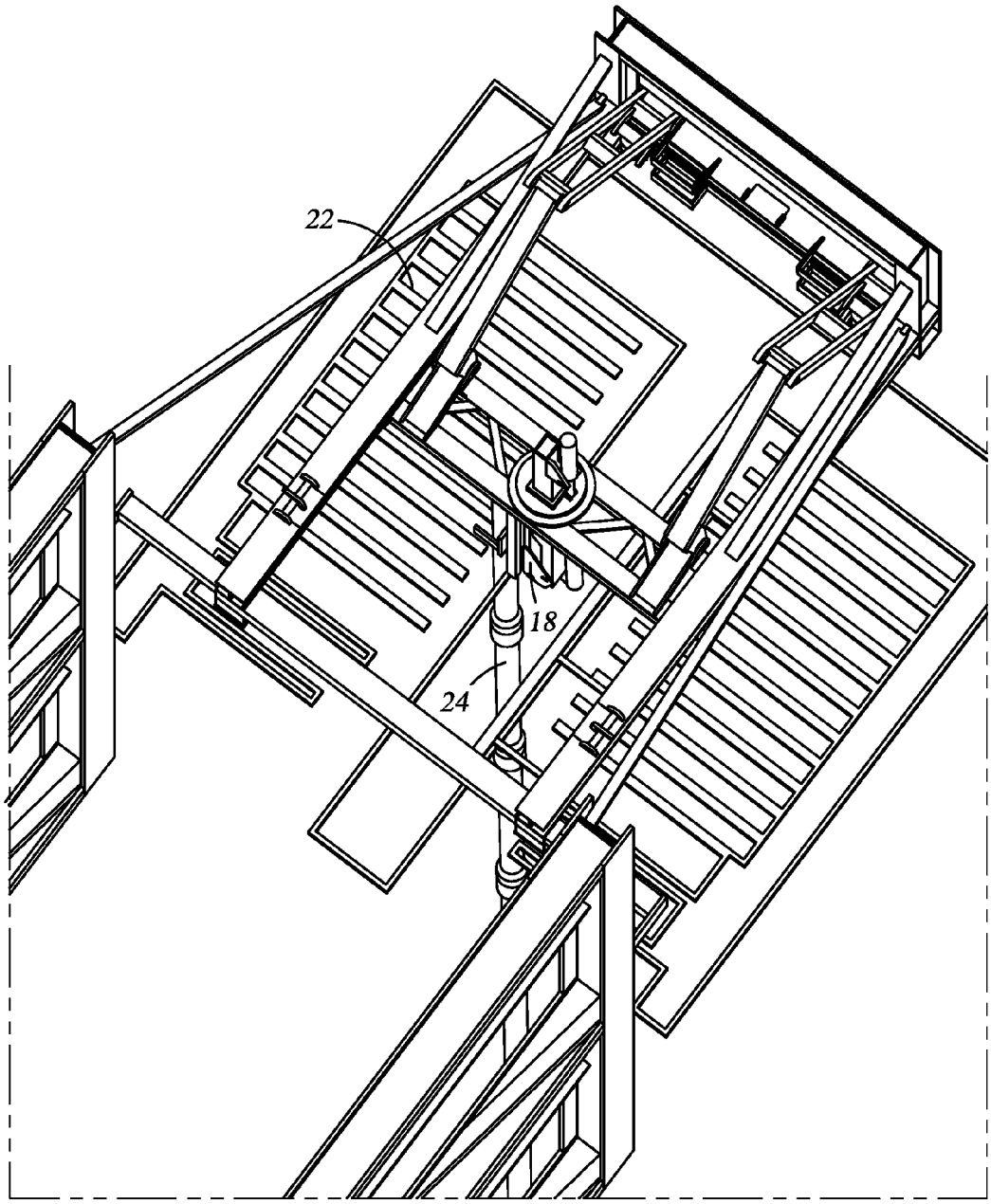
Figure 14:
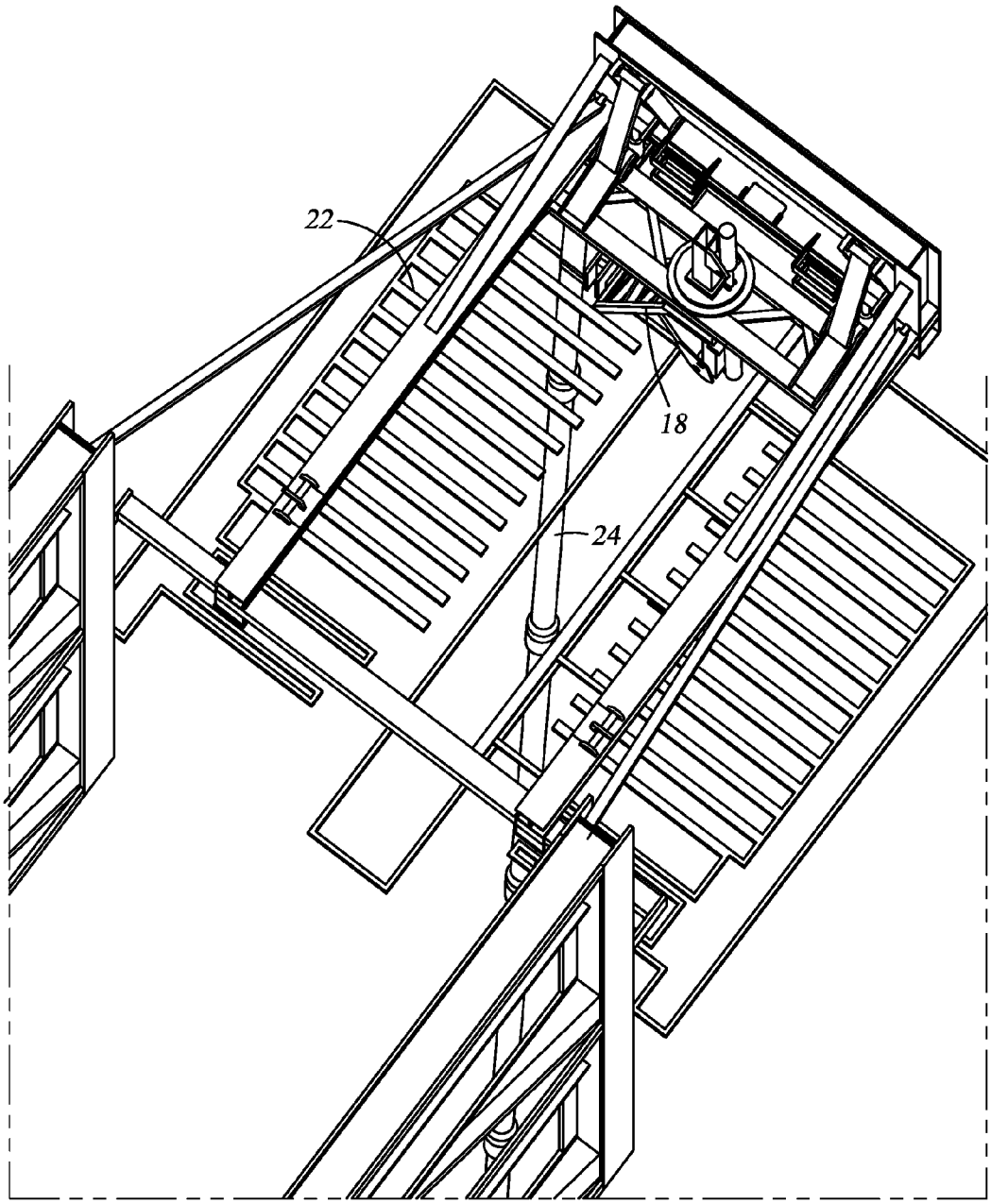
Figure 15:
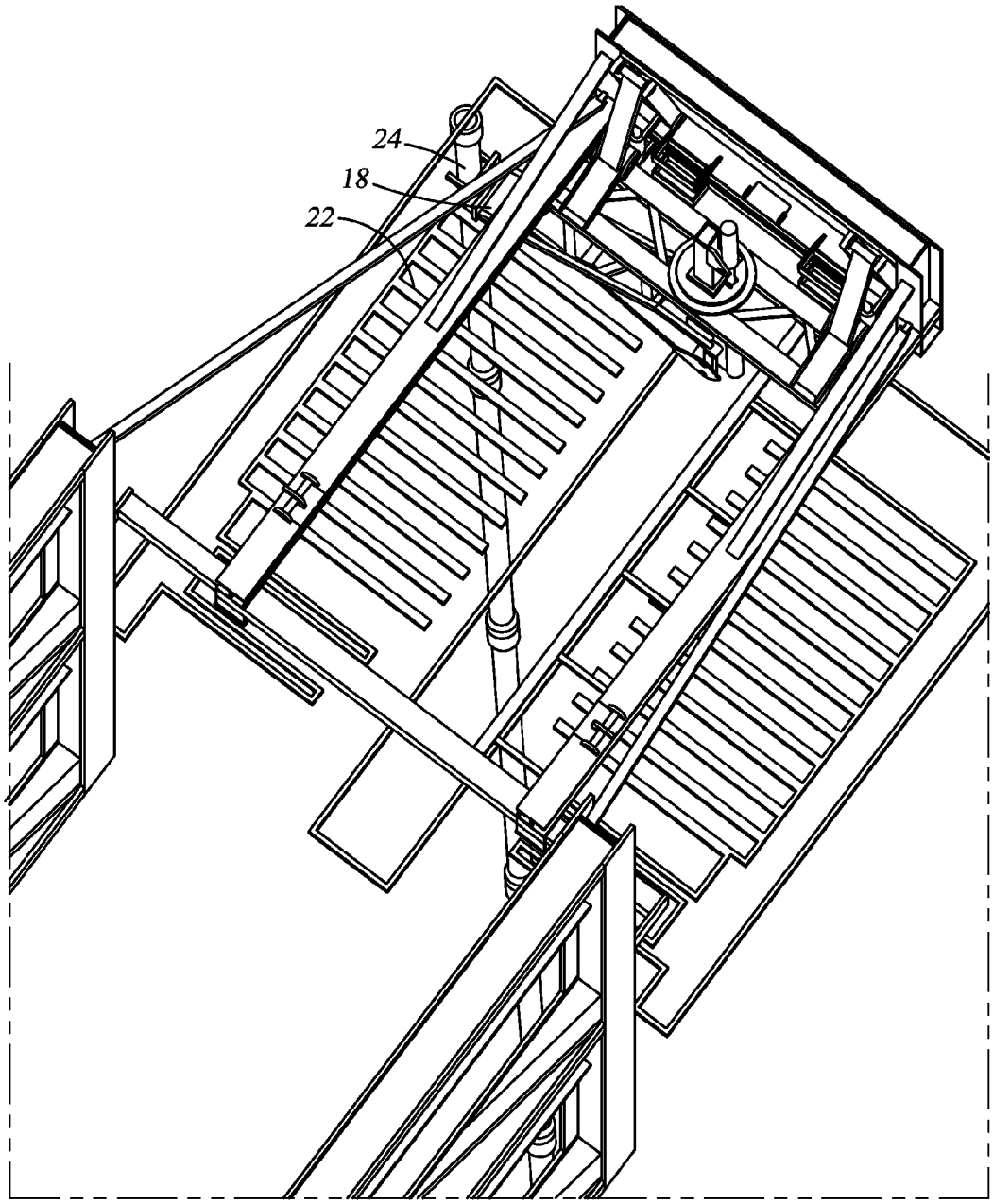

FIGS. 7-15 illustrate racking system 10 engaging pipe 24 for movement of the pipe into fingerboard 22. FIG. 7 illustrates pipe 24 disconnected from the drill string and supported by elevator 34 in a vertical position ready to be moved from well center. As shown in FIG. 8, the lower end of pipe 24 is first moved off of well center to the setback under fingerboard 22. Referring now to FIG. 9, gripping arm 18 is then extended so that grip jaw 36 engages pipe 24 below elevator 34. Once grip jaw 36 is engaged, elevator 34 can be released so that the pipe is supported by racking system 10, as shown in FIG. 10. FIGS. 11-13 are now referred to, wherein the view is shifted to substantially above the system 10 and fingerboard 22. Once pipe 24 is engaged, gripping arm 18 is rotated (shown in FIG. 12) and retracted (shown in FIG. 13) so as to move the pipe into fingerboard 22. Gripping arm 18 is then extended to move pipe 24 into its proper storage position within fingerboard 22, as shown in FIGS. 14-15. Once pipe 24 is stored, racking system 10 is returned to its starting position and is ready to engage the next stand of drill pipe.

Figure 16:
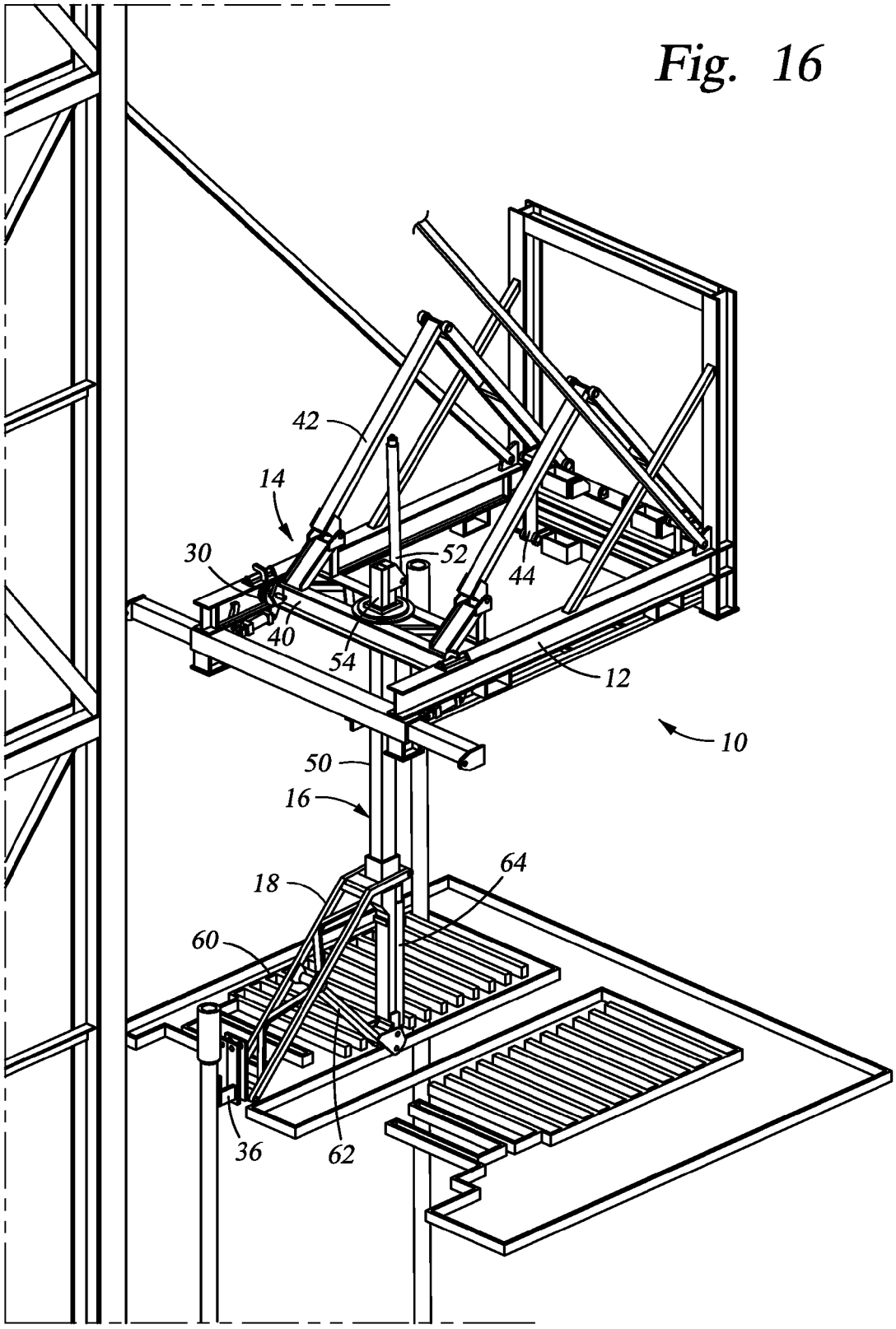
FIG. 16 illustrates a side elevation view of the mechanism of one embodiment of the pipe racking system of FIGS. 1-16.

The mechanism of one embodiment of pipe racking system 10 is shown in FIG. 16. Carriage 14 comprises bridge 40, articulated arm 42, and actuator or control cylinder 44. Bridge 40 is supported on frame 12 by wheels 30. Hydraulic cylinder 44 is connected to frame 12 and arm 42, which is pivotally coupled to the frame and bridge 40 such that extension and retraction of the hydraulic cylinder causes the articulated arm to move the bridge along the frame. Column 16 comprises post 50, vertical actuator or control cylinder 52, and rotation mechanism 54. Vertical cylinder 52 provides for the adjustment of the vertical position of post 50. Rotation mechanism 54 serves to rotate post 50 about its central axis. Gripping arm 18 comprises grip jaw 36, support arm 60, pivot arm 62, and actuator or control cylinder 64. Hydraulic cylinder 64 is coupled to support arm 60 and column 16 such that the vertical extension and retraction of the cylinder results in horizontal movement of grip jaw 36.

The pipe racking system 10 shown in FIGS. 1-16 operates to control and position the upper end of a drill pipe stand as it is moved horizontally into and out of a pipe storage area, or setback. During operation of pipe racking system 10, the lower end of the drill pipe can be guided by rig personnel on the drill floor. In certain embodiments, a setback handling system may be utilized to capture and control the lower end of the drill string in the setback area, thereby eliminating the need for direct involvement of rig personnel. It should also be understood that the following embodiments of a setback handling system can be used with other drilling structures extending above a drill floor, such as a derrick, and also with a vertical ground racking system wherein the setback area is on the ground or rig floor at the rig site. Description of the embodiments with reference to a drilling mast is for illustrative purposes only.

Figure 17A:
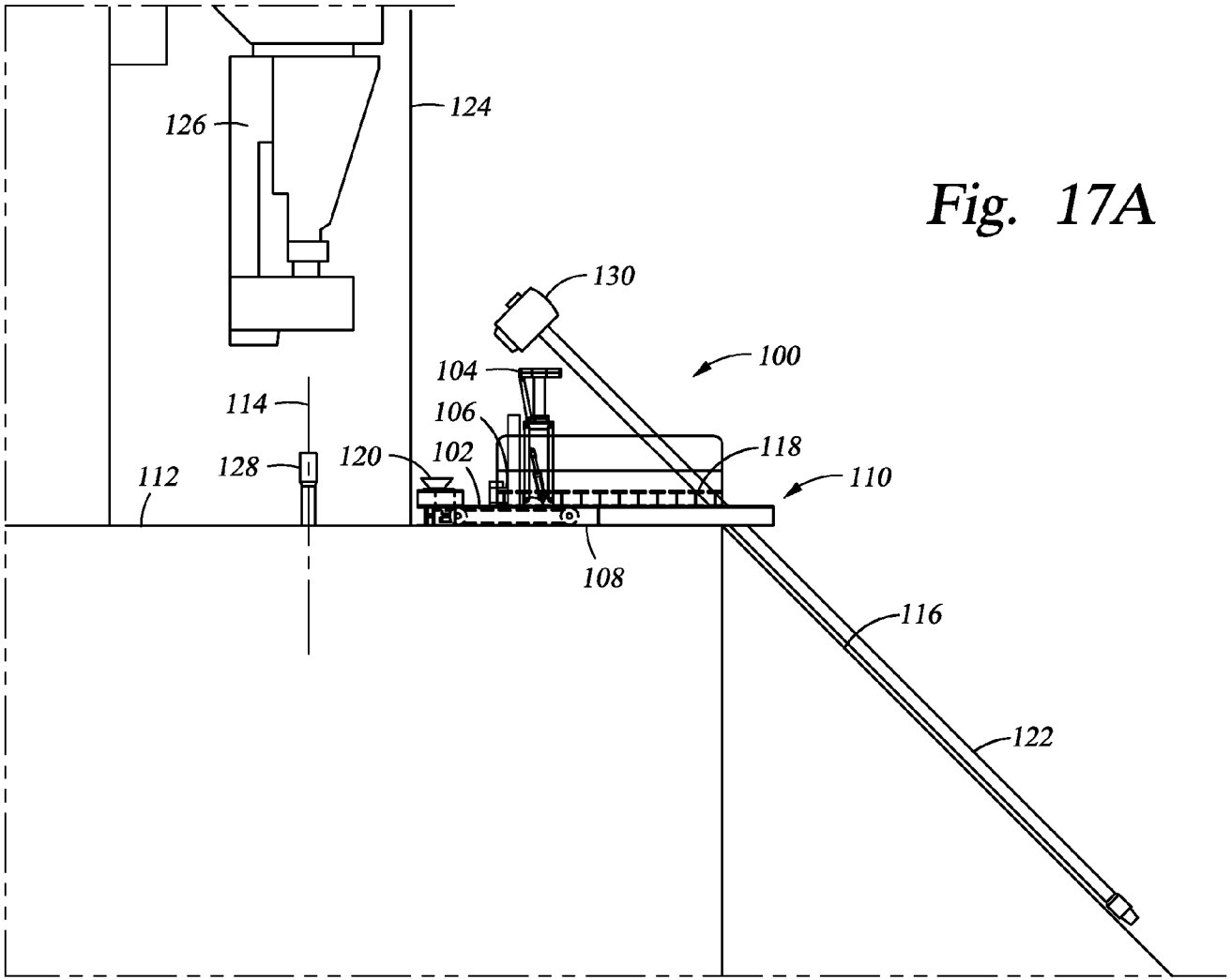
FIGS. 17A-34 illustrate side elevation and top-down views of a setback handling system constructed in accordance with embodiments of the present invention.
Figure 17B:
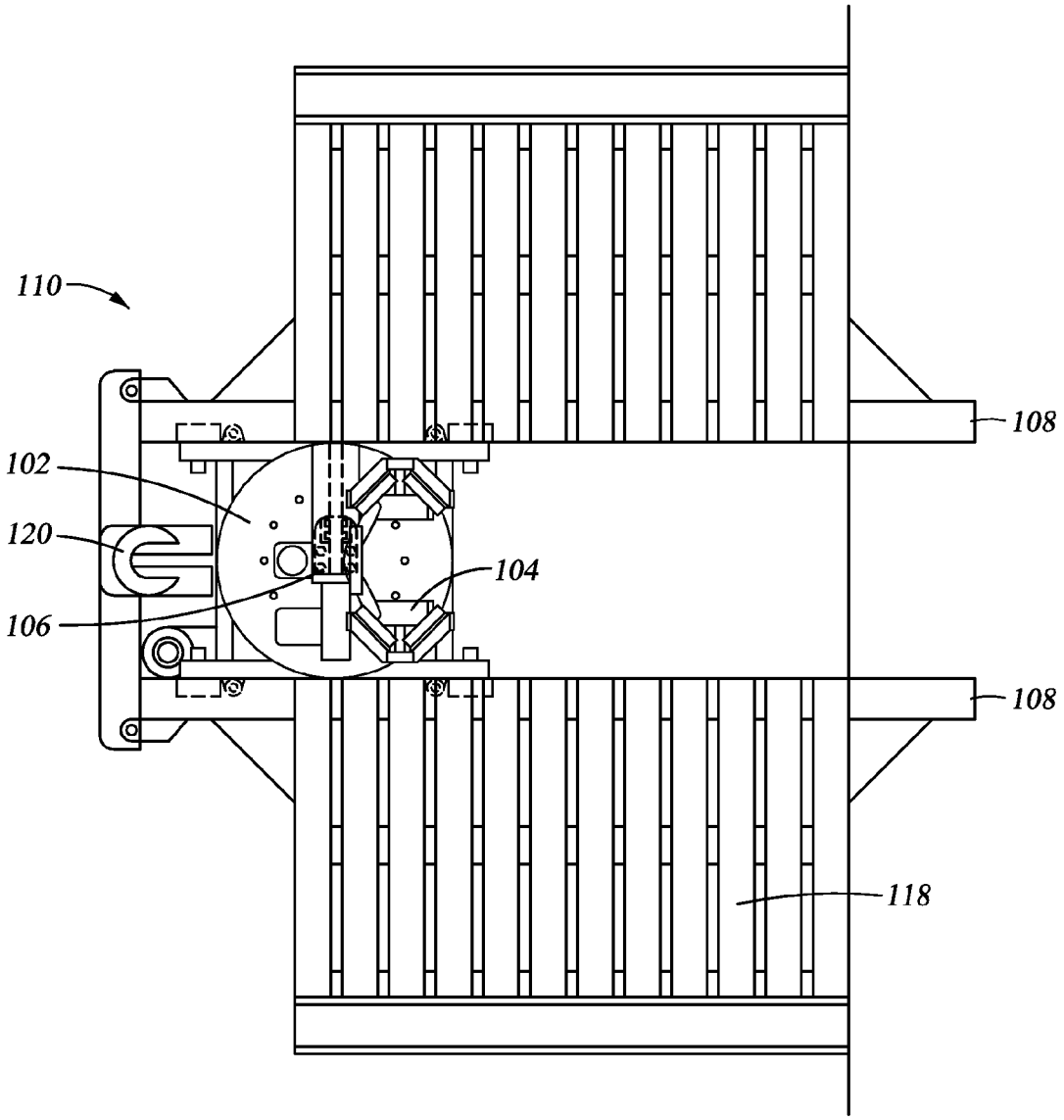
Figure 18A:
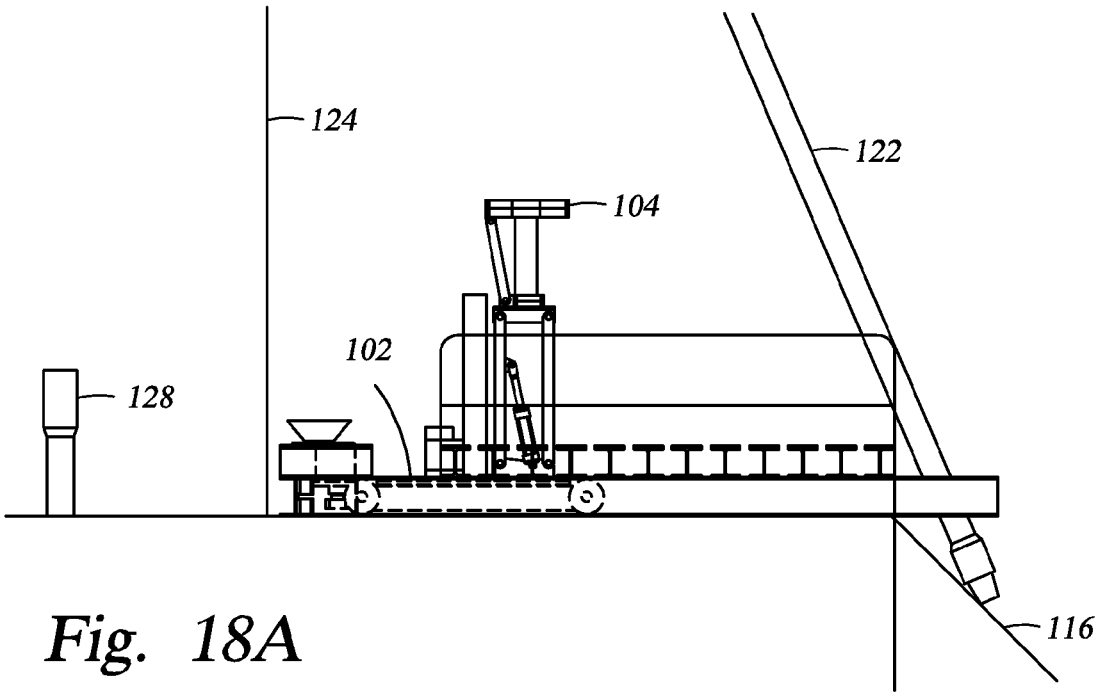
Figure 18B:
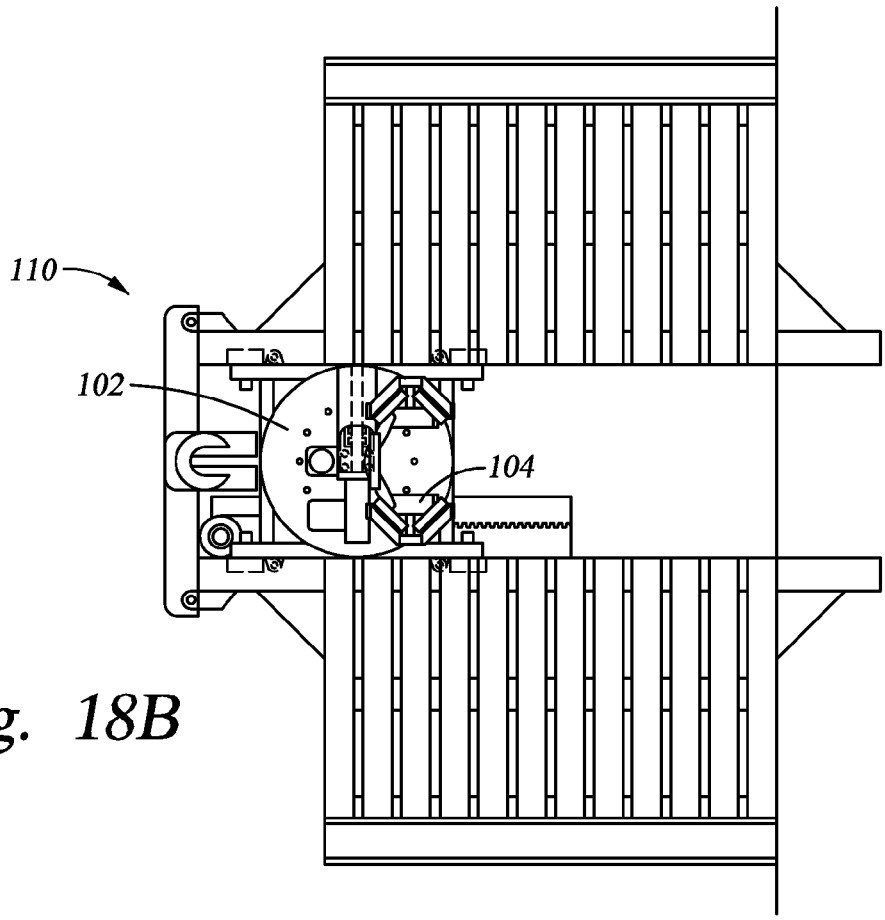
Figure 19A:
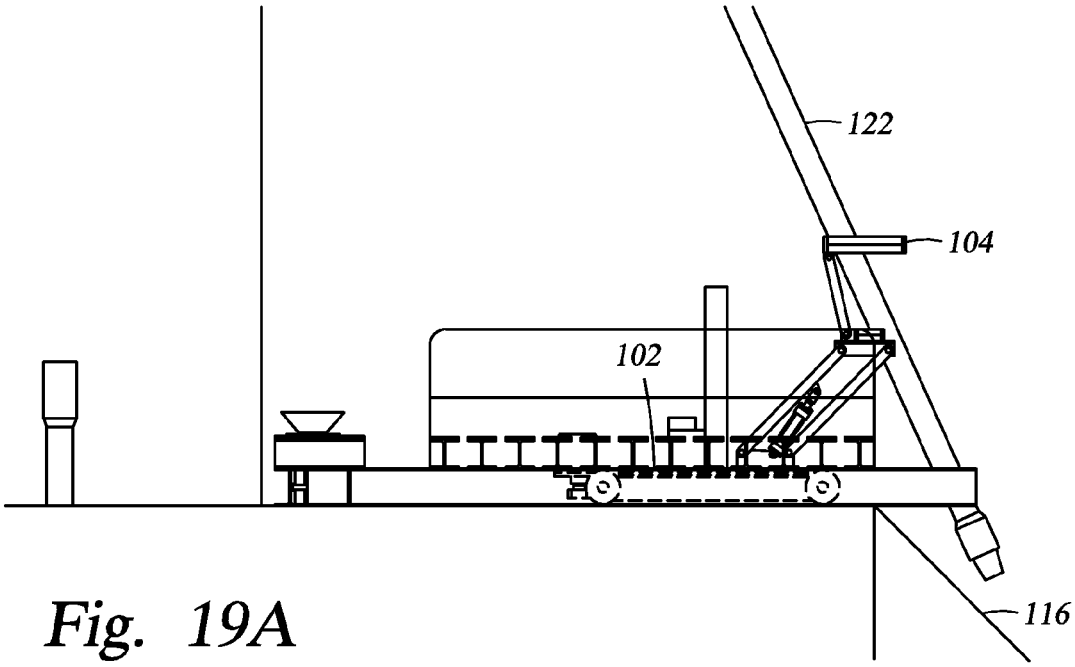
Figure 19B:
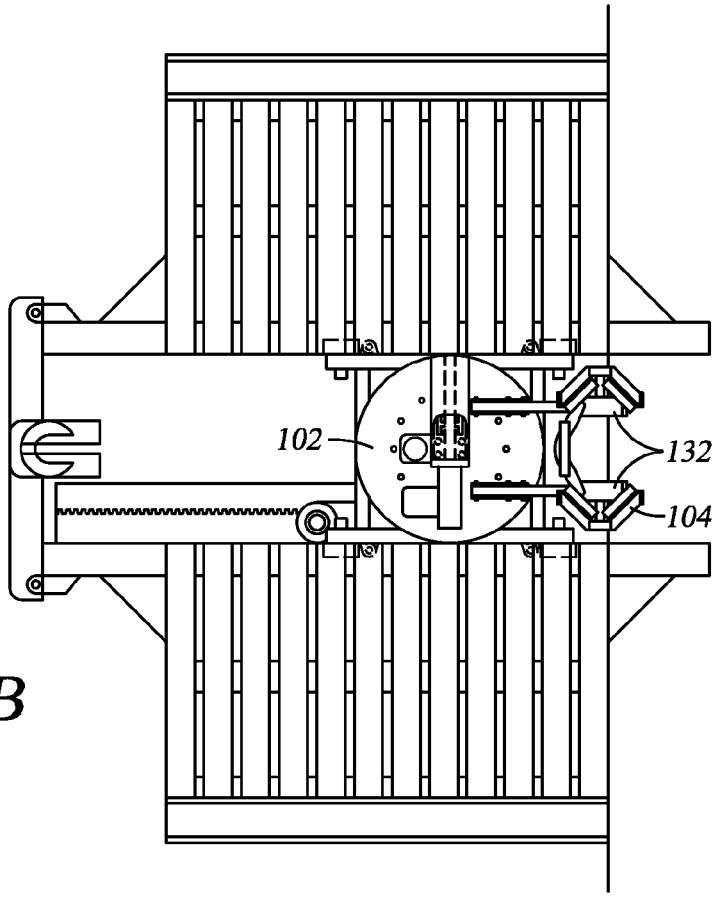
Figure 20A:
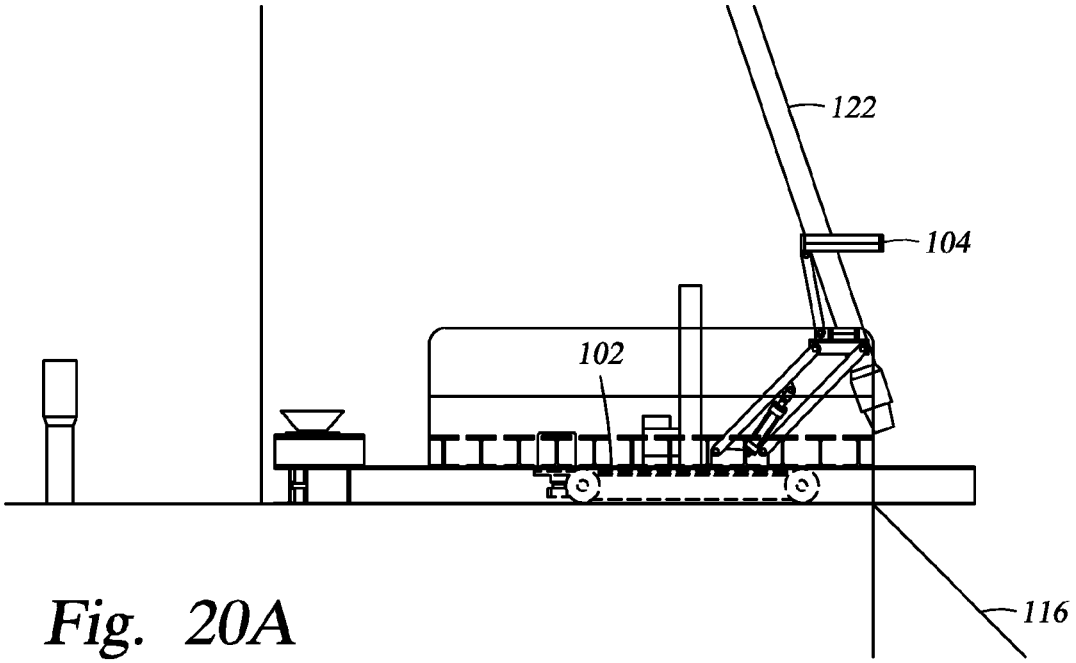
Figure 20B:
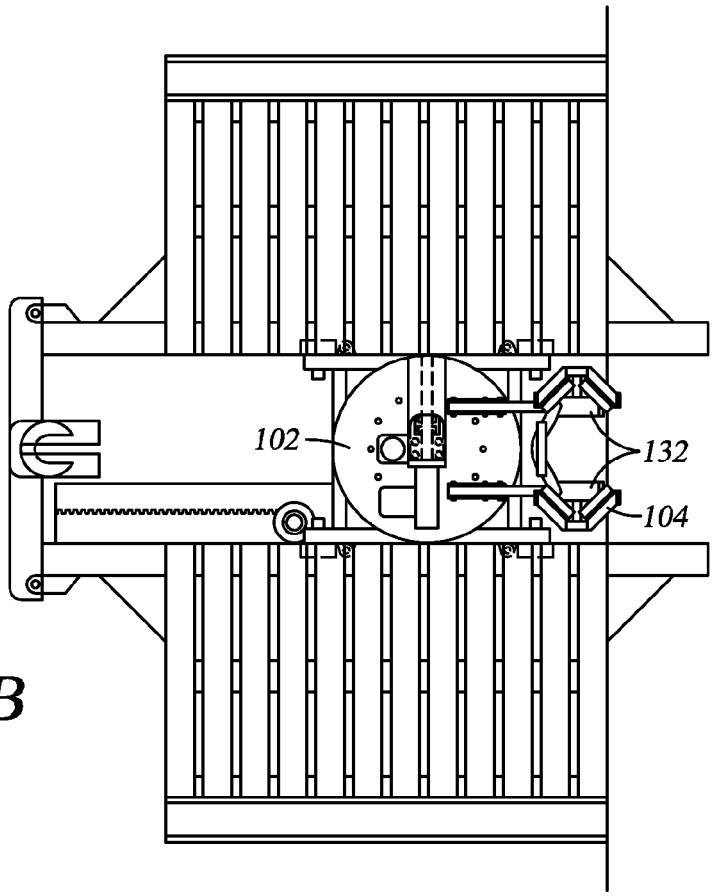

FIGS. 17A and 17B illustrate one embodiment of a setback handling system 100 comprising rotating table 102 having pipe guide 104 and pipe mover 106. Rotating table 102 is slidingly disposed on tracks 108 that run through setback rack 110. Setback rack 110 is positioned on drill floor 112 between well center 114 and pipe ramp 116. Setback rack 110 also comprises support beams 118 and capture funnel 120.

FIGS. 17A-24B illustrate setback handling system 100 being used to guide single joints of drill pipe 122 into mast 124, or other drilling structure or rig site, such as would happen during the beginning of drilling operations. With each of the figures, a top-down view of setback handling system 100 (such as FIG. 17B) is included along with a side elevation view (such as FIG. 17A) in order to understand how the system is operating. In FIG. 17A, top drive 126 is in its lowest position and has been disconnected from drill string 128. Pipe elevator 130 is swung outward from well center 114 and is engaged with an upper end of drill pipe 122 on pipe ramp 116. Rotating table 102 is moved to its innermost position and pipe guide 104 is oriented toward pipe ramp 116. Top drive 126 is then moved back toward the top of mast 124 along with the elevator and drill pipe 122, as shown in FIG. 18A.

Figure 21A:
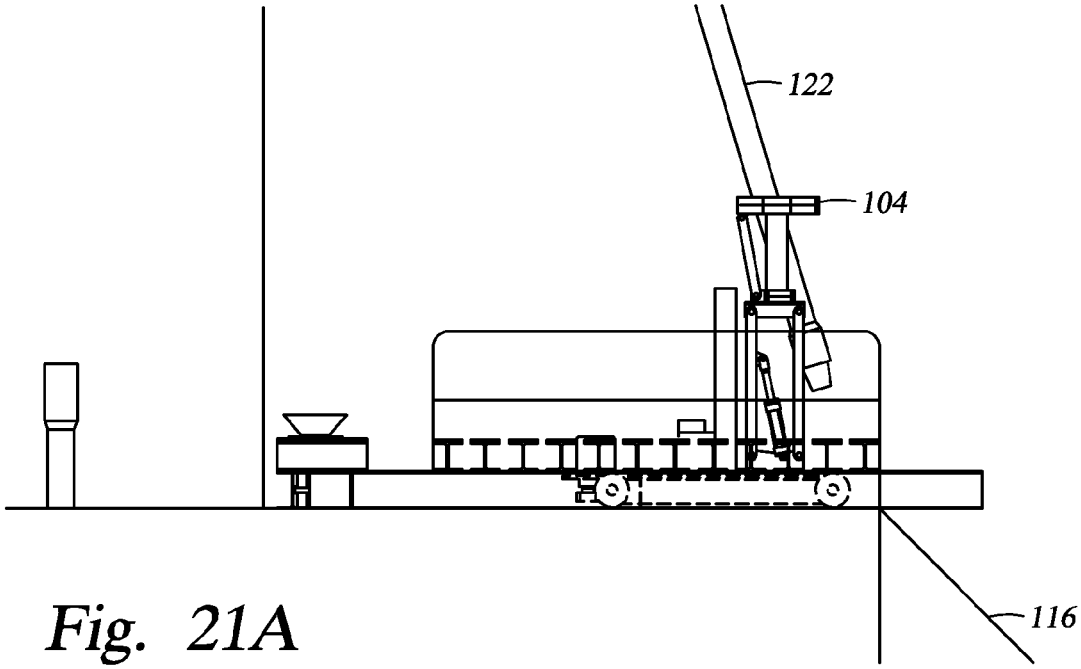
Figure 21B:
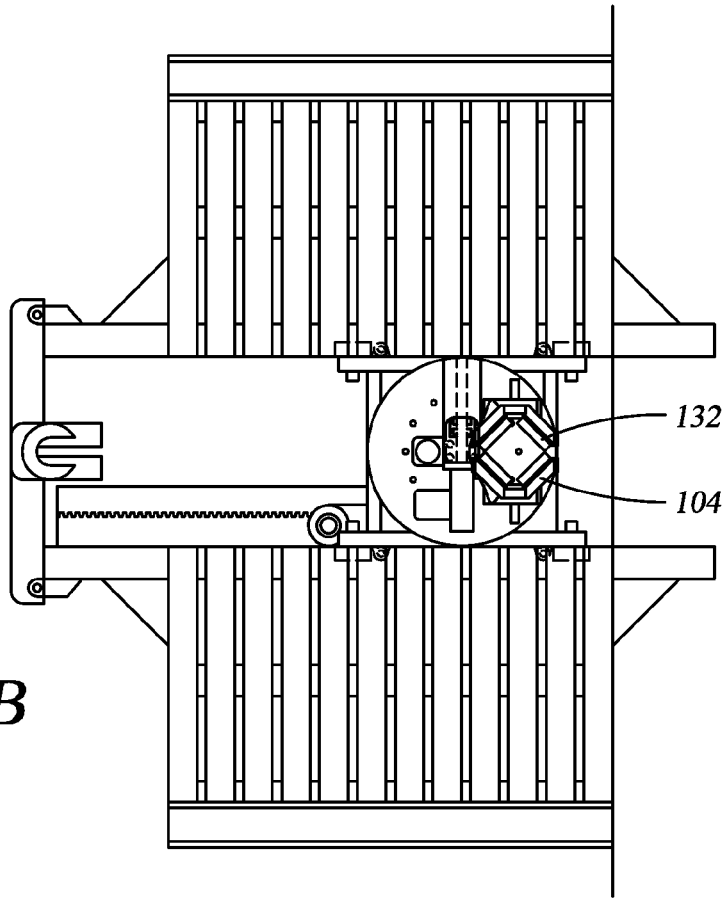
Figure 22A:
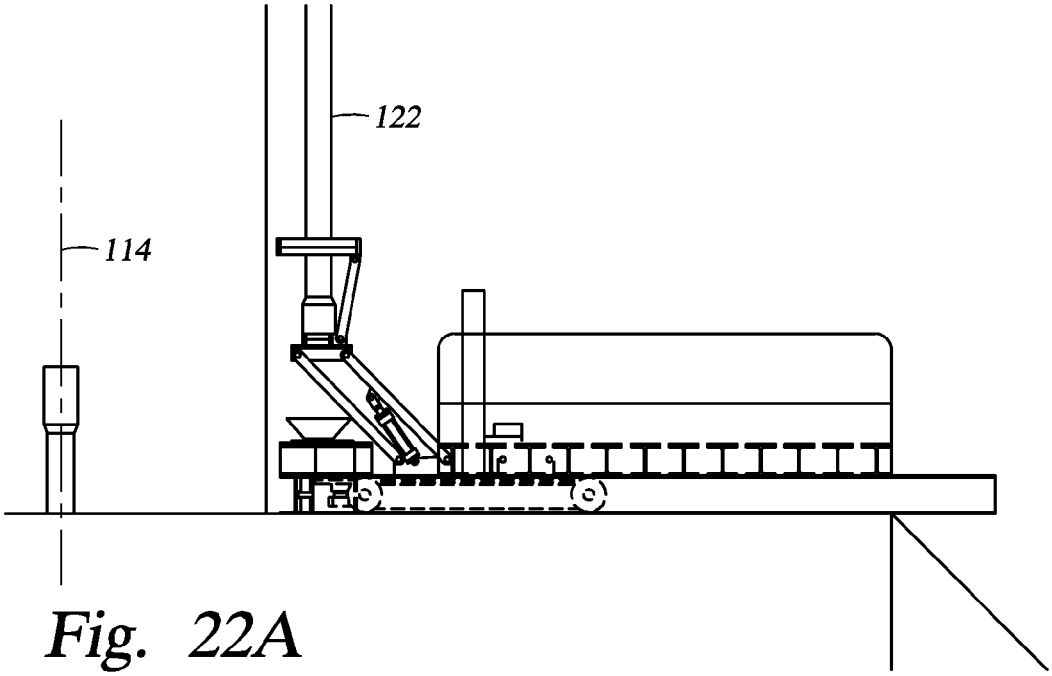
Figure 22B:
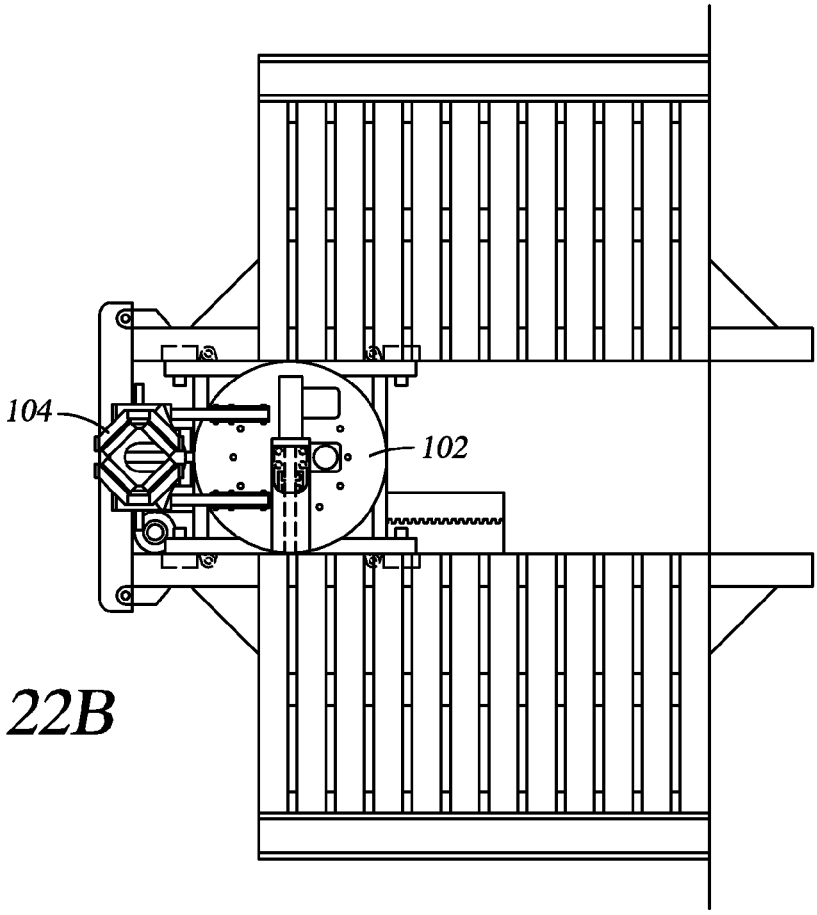
Figure 23A:
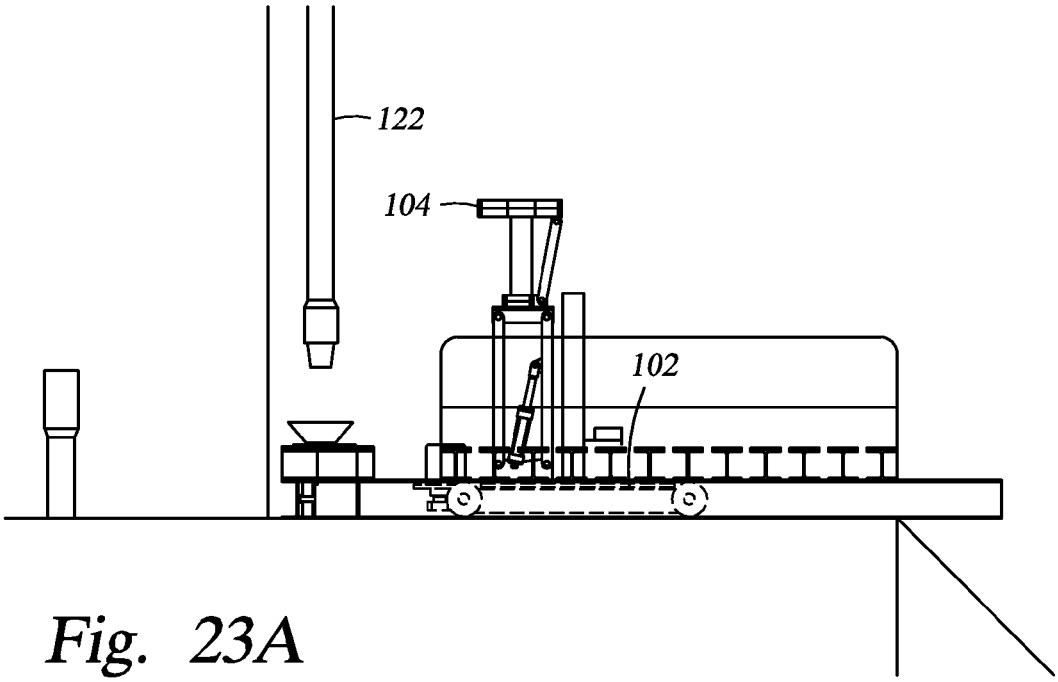
Figure 23B:
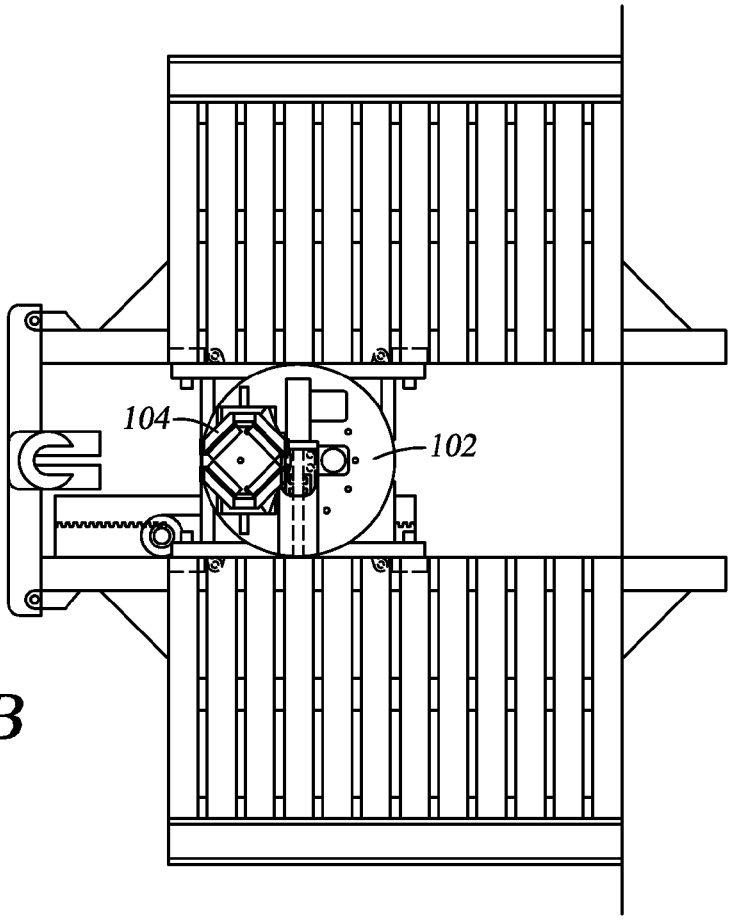
Figure 24A:
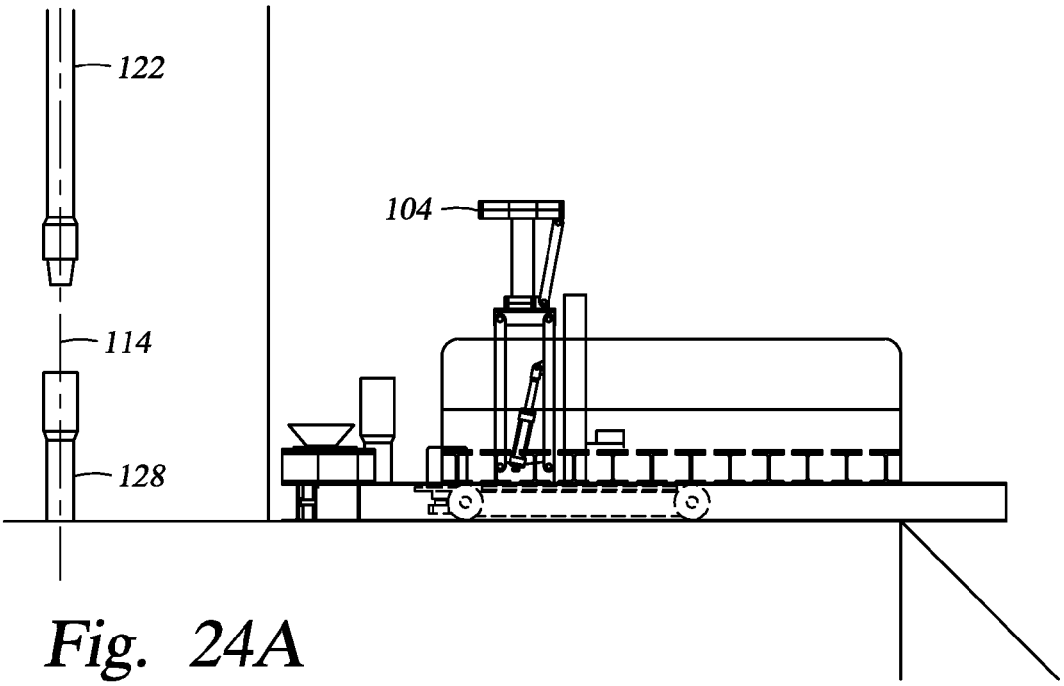
Figure 24B:
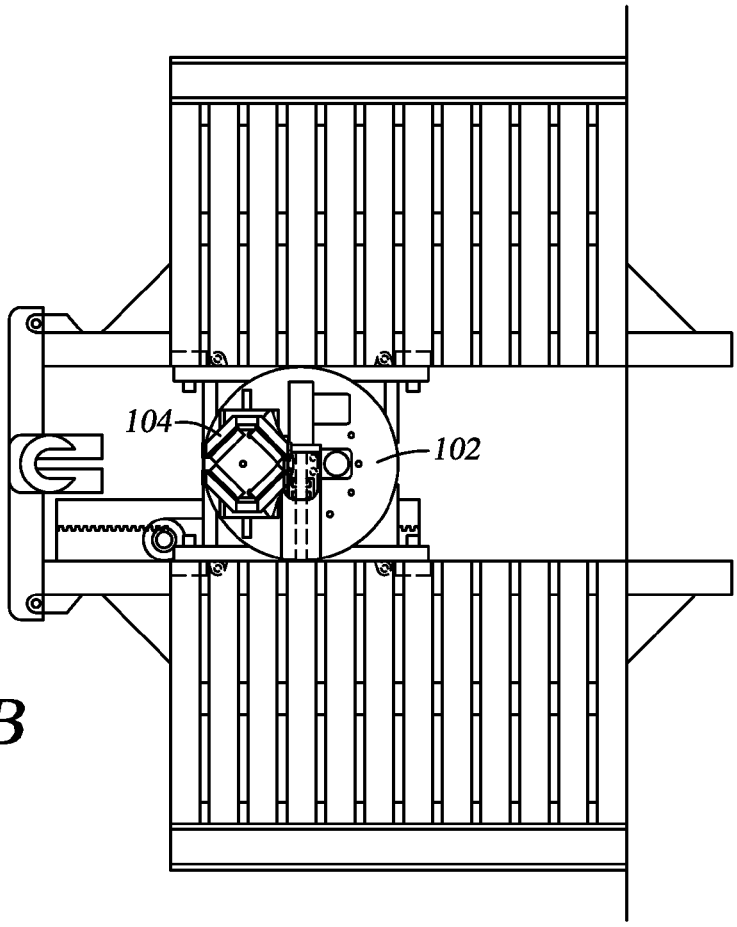
Figure 25A:
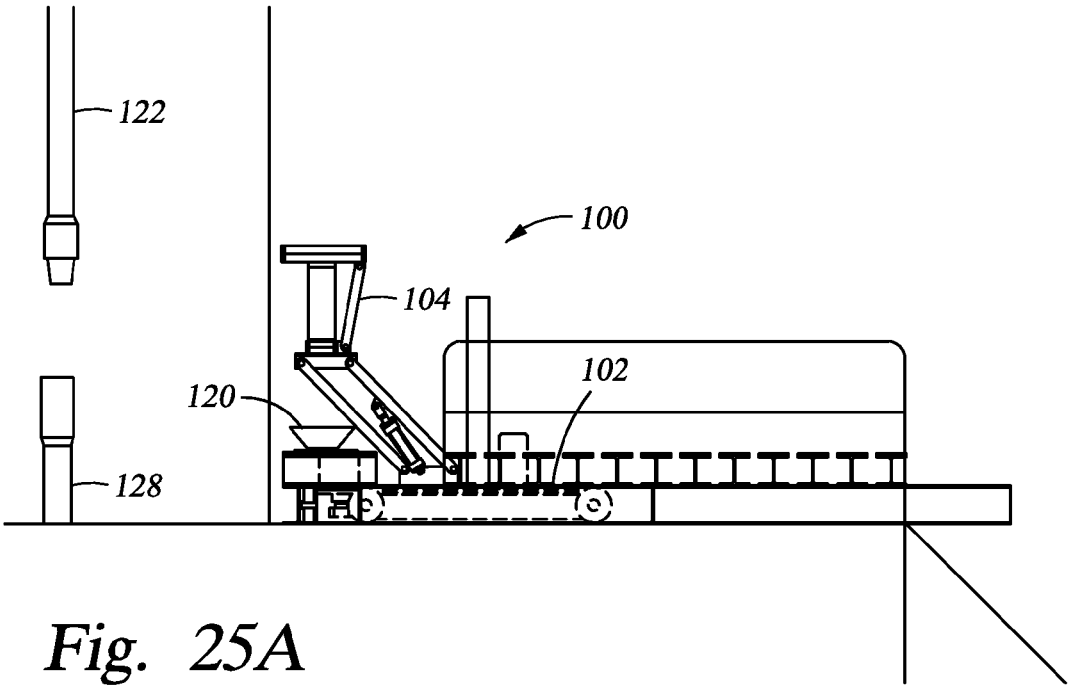
Figure 25B:
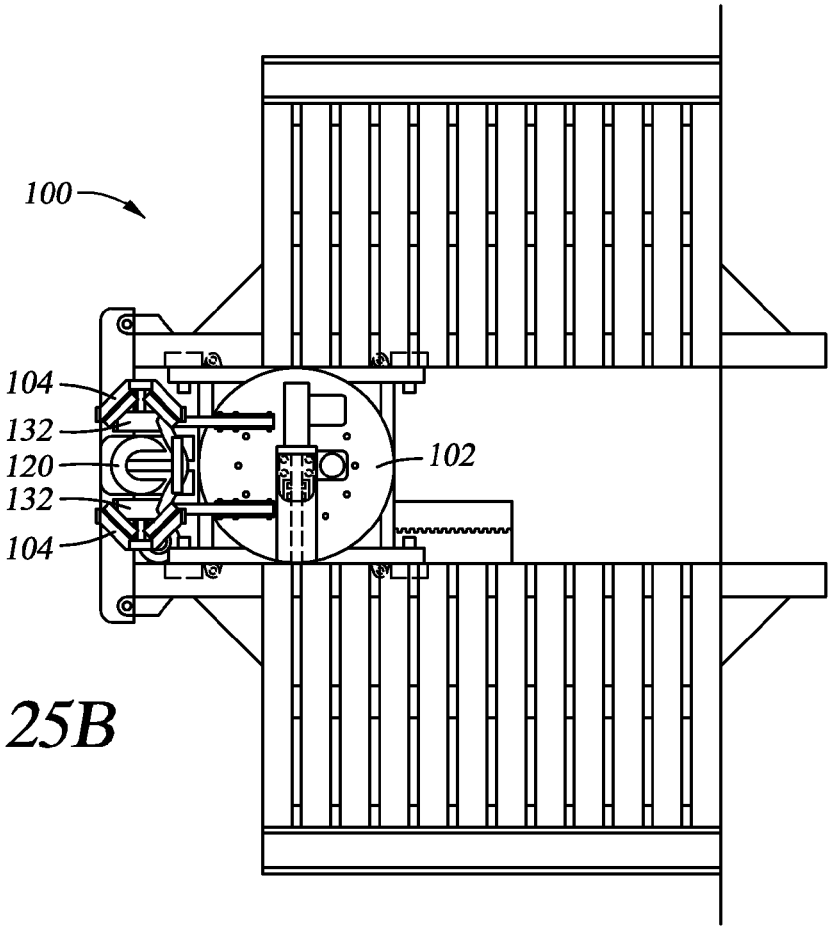
Figure 26A:
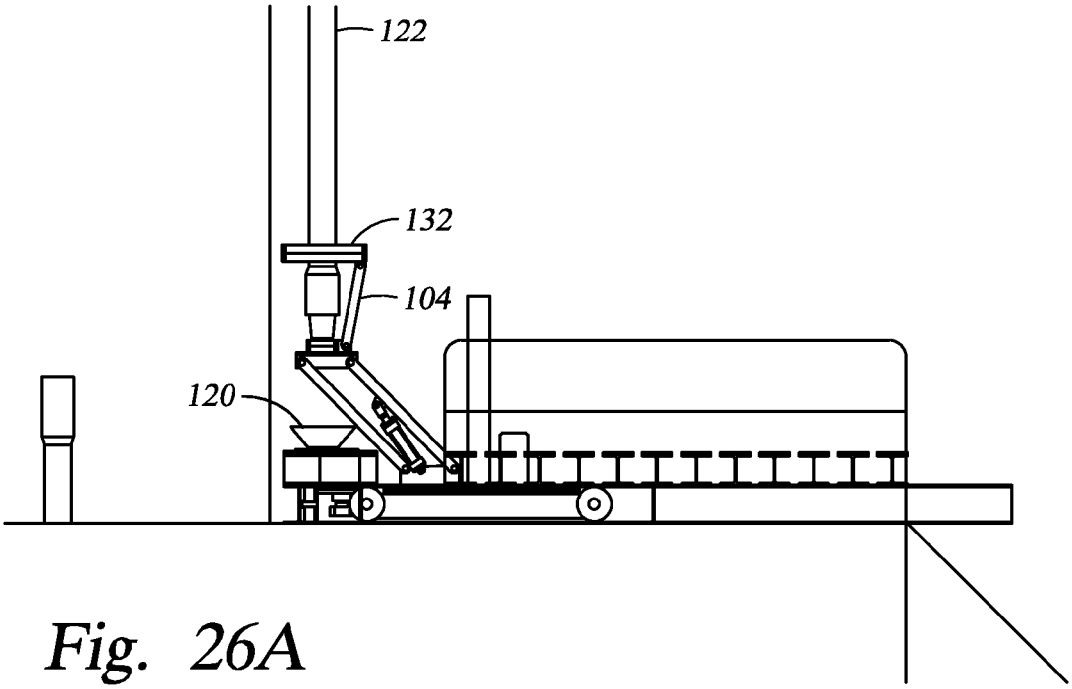
Figure 26B:
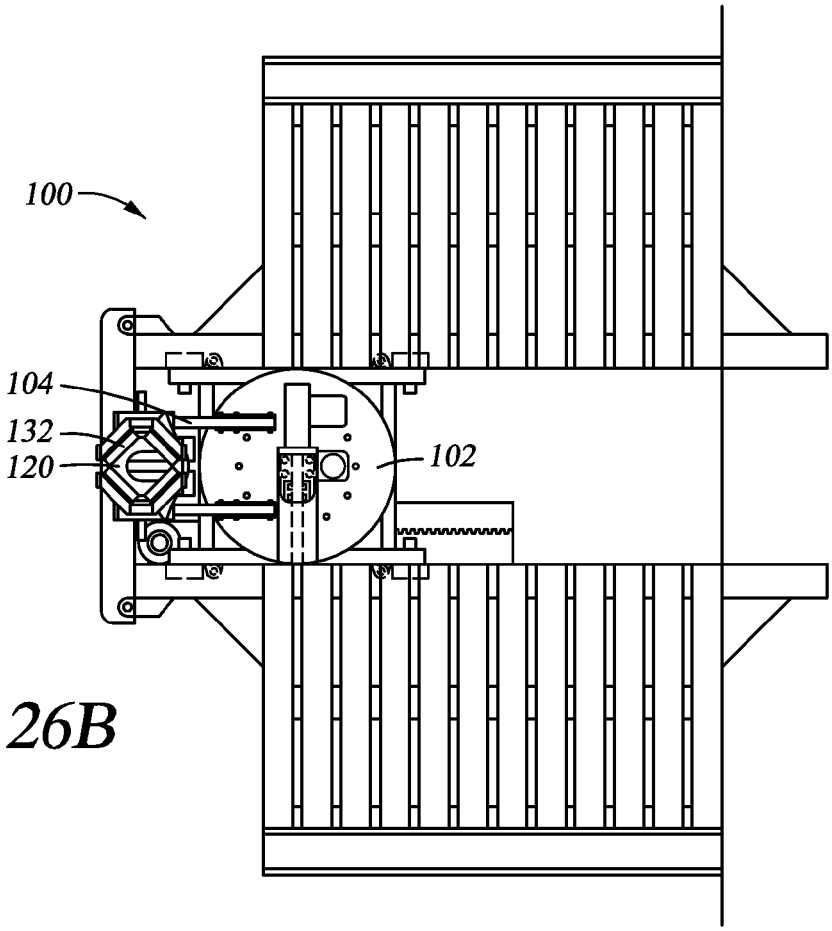
Figure 27A:
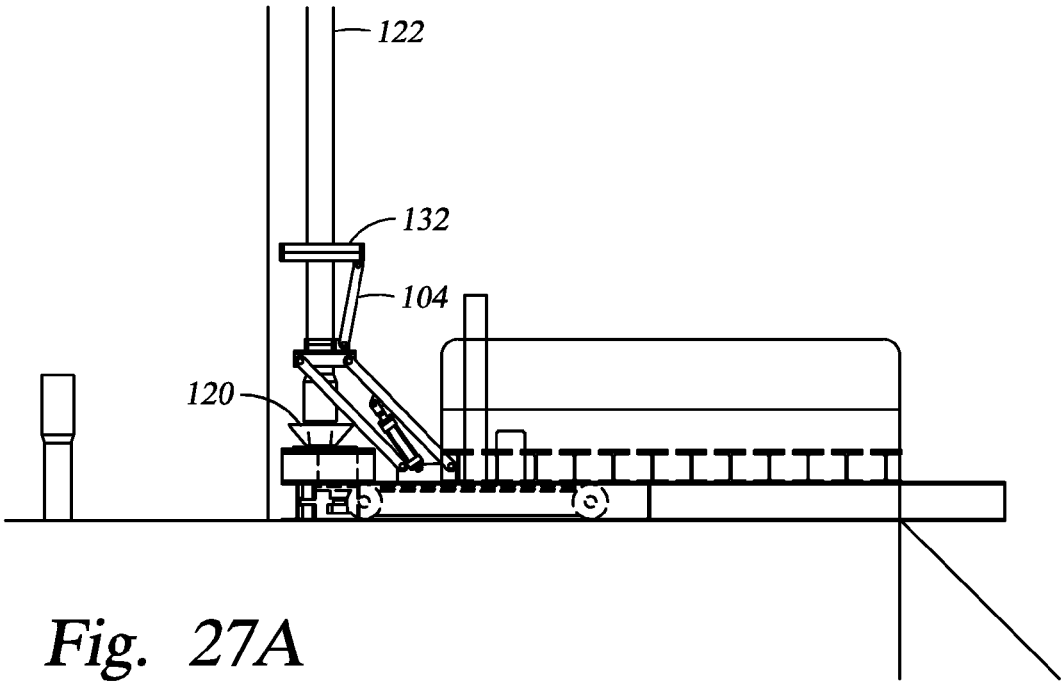
Figure 27B:
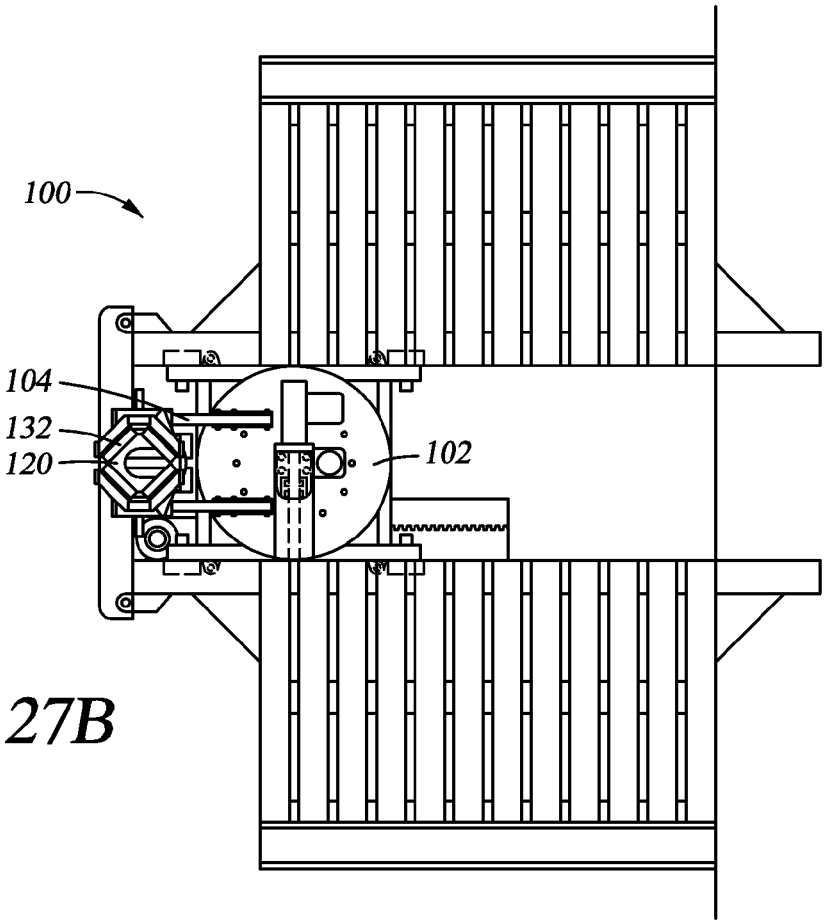
Figure 28A:
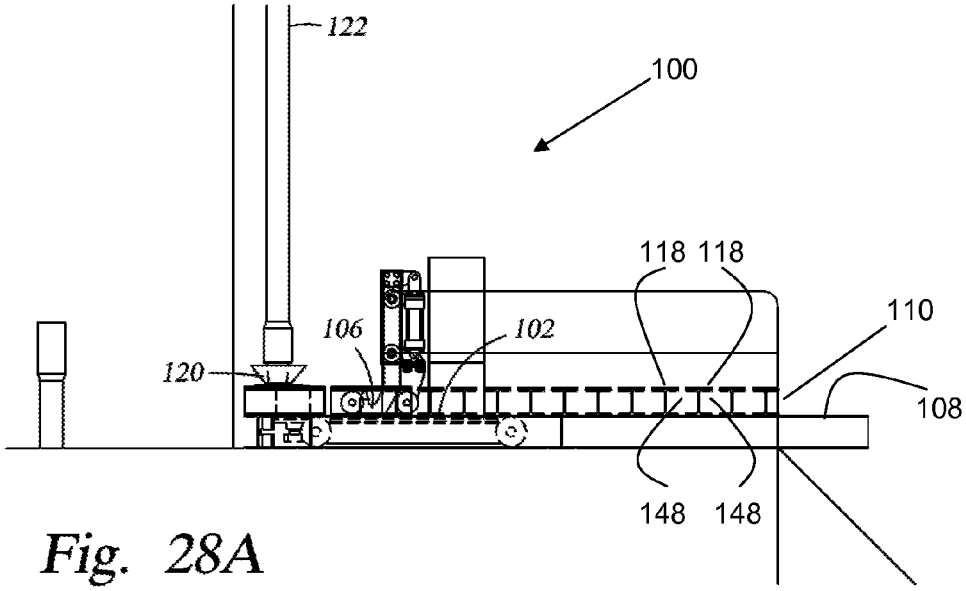
Figure 28B:
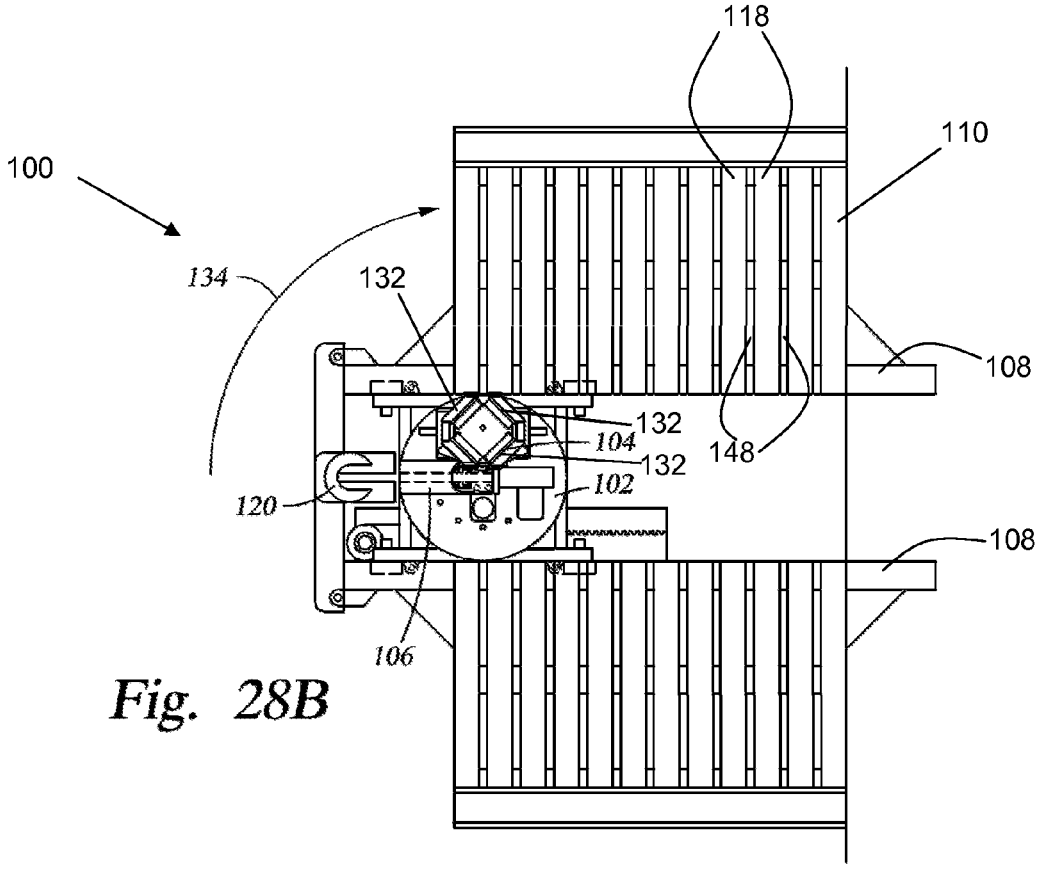

As the tailing or lower end of drill pipe 122 approaches the top of pipe ramp 116, table setback handling system 102 is moved toward pipe ramp 116 and pipe guide 104 is extended by actuator 115 so that rollers 132 contact drill pipe 122, as is shown in FIGS. 19A-20B. As shown in FIGS. 21A and 21B, once drill pipe 122 clears pipe ramp 116, pipe guide 104 is returned to its upright position (FIG. 21A) by actuator 115 and rollers 132 are closed to capture the tailing end of the drill pipe (FIG. 21B). Referring now to FIG. 22A, once drill pipe 122 is captured, table 102 is moved toward well center 114. In FIG. 22B, it is shown that table 102 is rotated by an actuator so that pipe guide 104 can be extended such that the drill pipe hangs vertically from the elevator (not shown). Pipe guide 104 can then be released and retracted (as shown in FIGS. 23A and 23B) and drill pipe 122 moved to well center 114 by the elevator (not shown) and aligned with drill string 128 (as shown in FIGS. 24A and 24B).

FIGS. 25A-34B illustrate setback handling system 100 being used during a tripping operation to store drill pipe in the setback area. As is shown in FIGS. 25A-27B, a stand of drill pipe 122 is disconnected from drill string 128 and its lower end is guided to guide funnel 120 by rollers 132 of pipe guide 104. Once drill pipe 122 is set in guide funnel 120, as is shown in FIG. 28A, pipe guide 104 is disengaged and table 102 is rotated ninety degrees, shown by arrow 134, so that pipe mover 106 is aligned with guide funnel 120.

Figure 29:
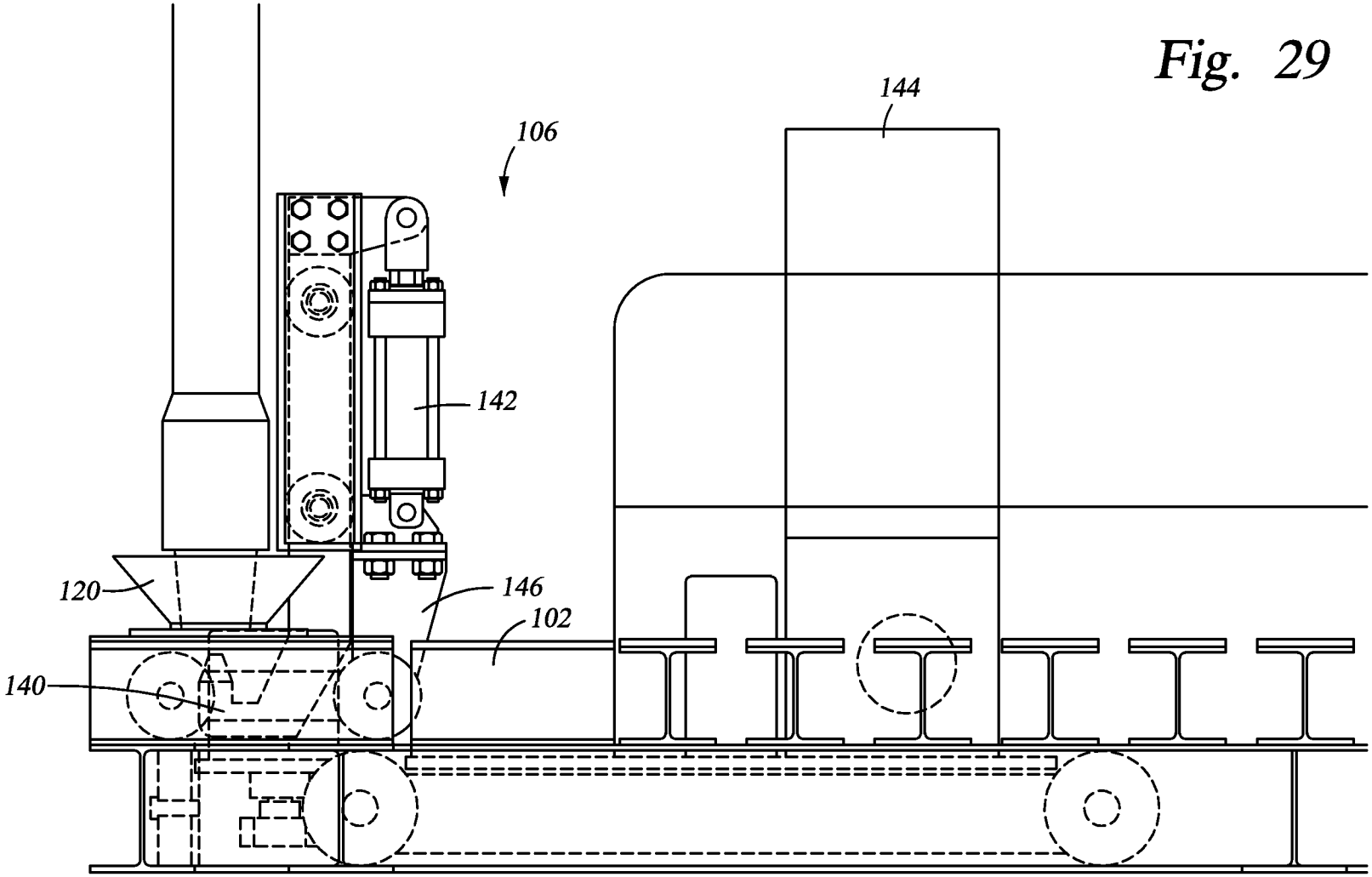

Referring now to FIG. 29, pipe mover 106 comprises engagement finger 140, actuator or lift cylinder 142, push/pull mechanism 144, and sled 146. Sled 146 is slidably coupled to table 102 and is moved horizontally by push/pull mechanism 144. In certain embodiments, push/pull mechanism is a push-pull chain or a rigid chain. Engagement finger 140 is moveably mounted to sled 146 such that lift cylinder 142 controls the vertical position of the finger.

Figure 30A:
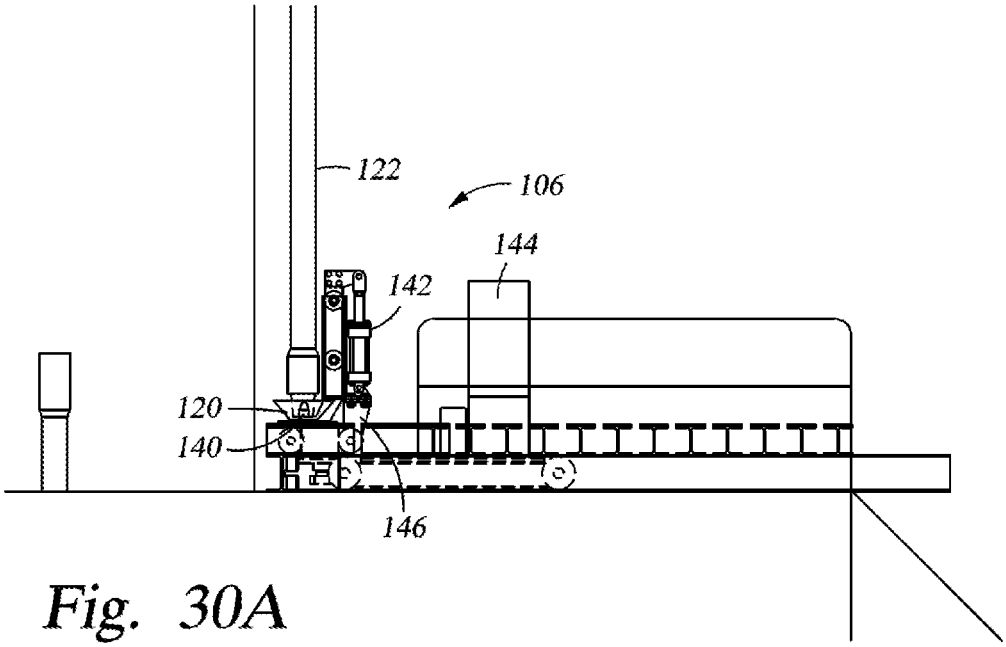
Figure 30B:
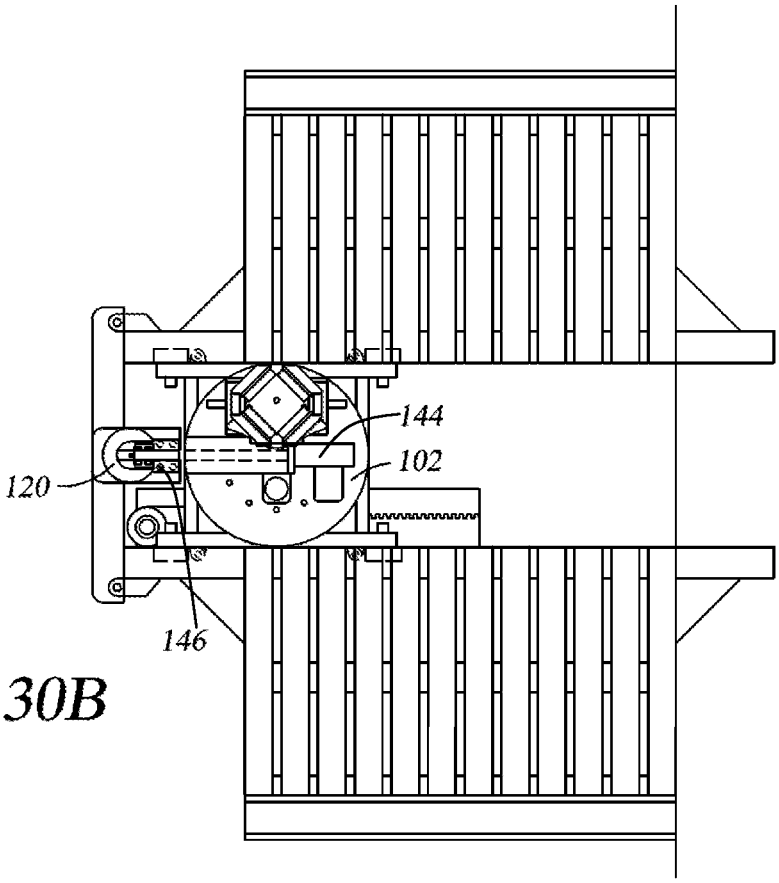
Figure 31A:
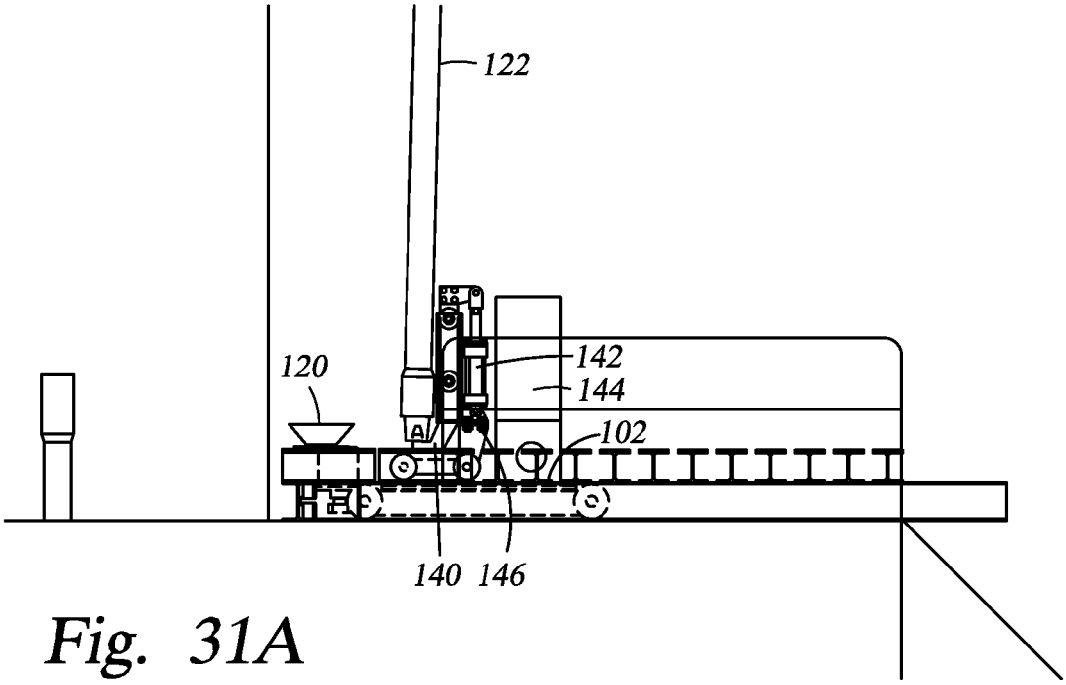
Figure 31B:
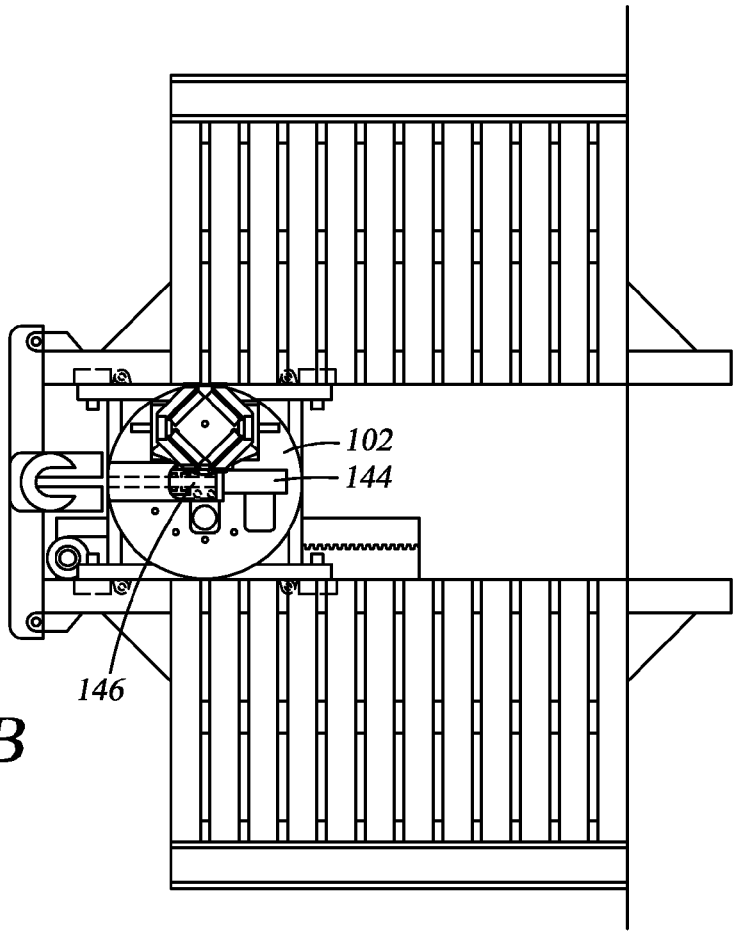
Figure 32A:
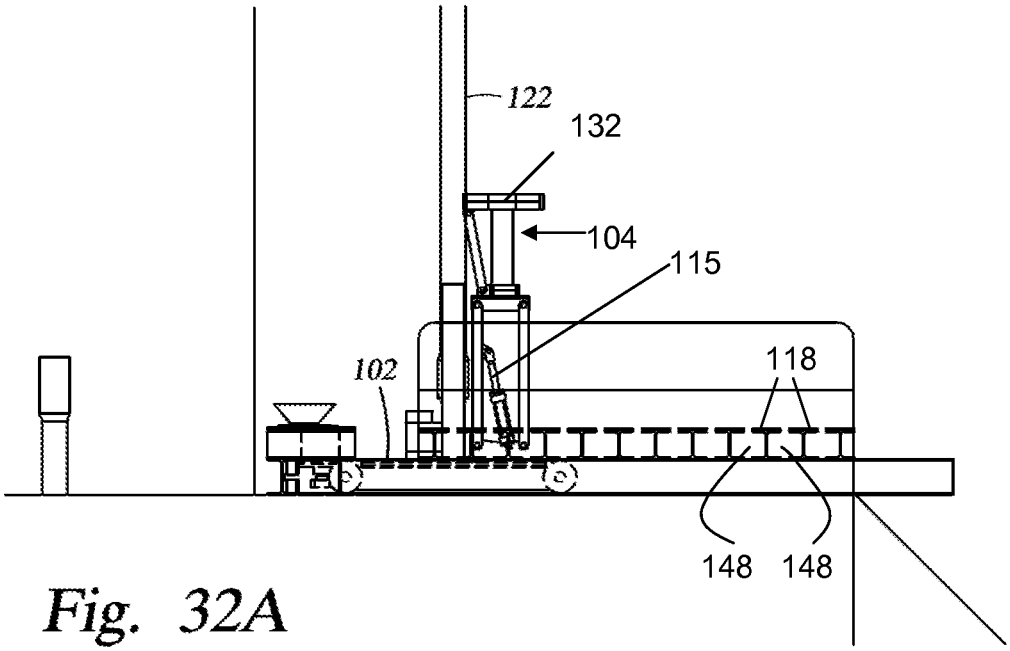
Figure 32B:
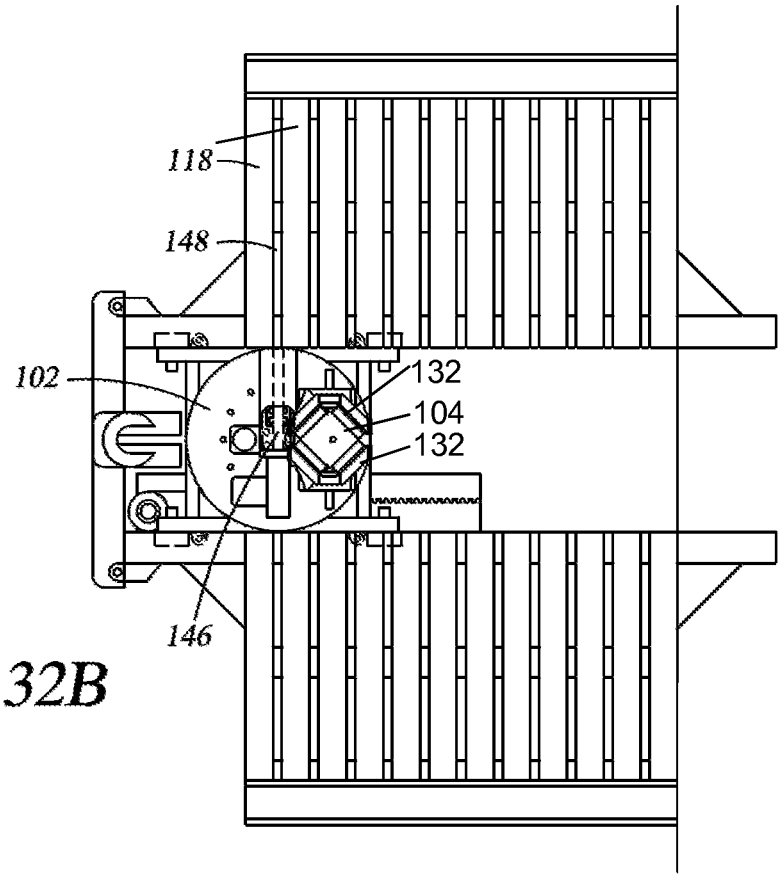
Figure 33:
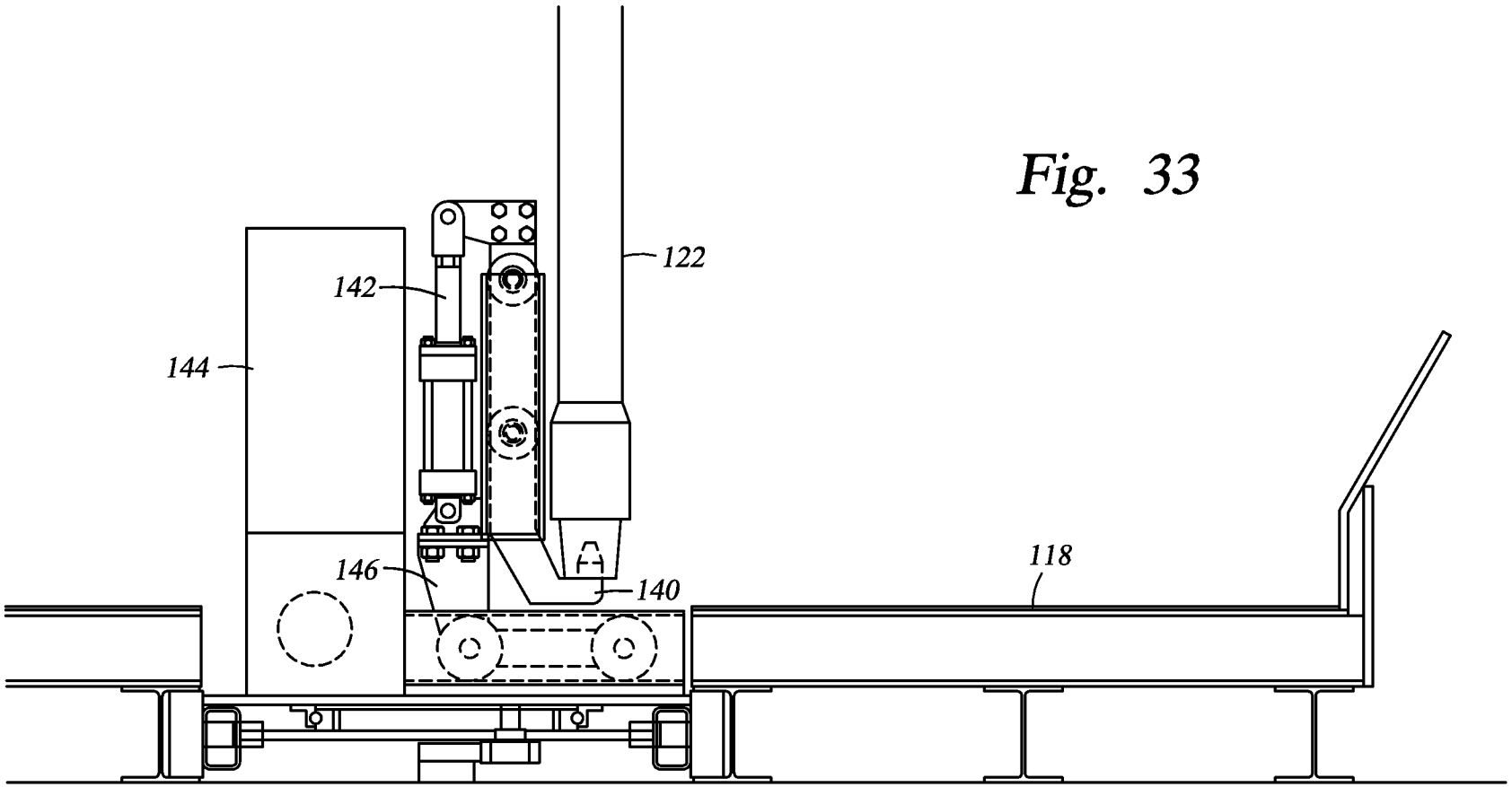
Figure 34:
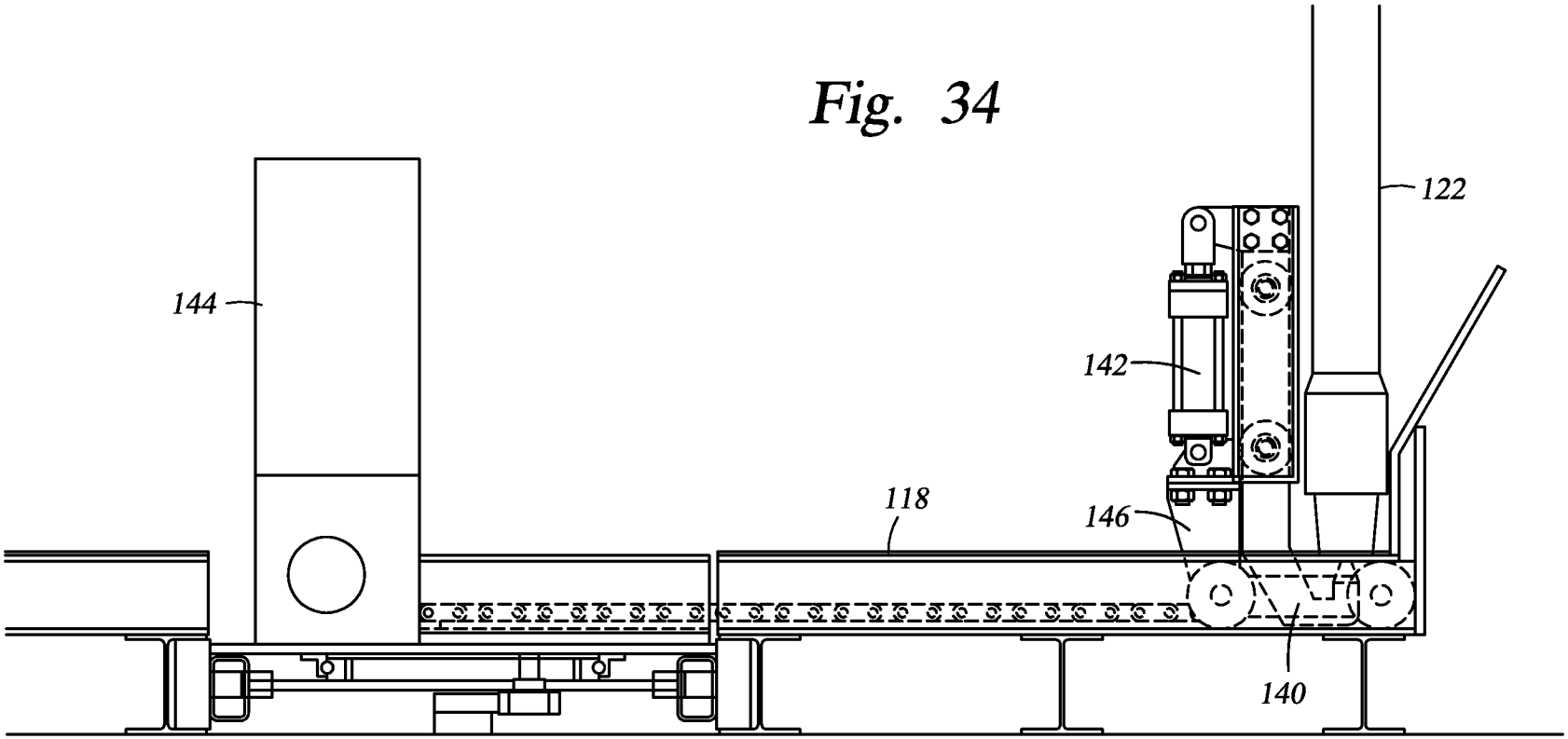

Pipe mover 106 engages drill pipe 122 by raising engagement finger 140 underneath the drill pipe as shown in FIG. 30A. Lift cylinder 142 raises engagement finger 140 so that drill pipe 122 clears guide funnel 120 and push/pull mechanism 144 moves sled 146 back toward the center of table 102 as shown in FIGS. 31A and 31B. Referring now to FIGS. 32A and 32B, table 102 is then rotated ninety degrees so that sled 146 is aligned with slot 148 between support beams 118. As shown in FIGS. 33-34, once aligned, push/pull mechanism 144 moves sled 146 and drill pipe 122 outward to a desired storage position and lowers engagement finger 140 so that the drill pipe is supported on beams 118.

Figure 35:
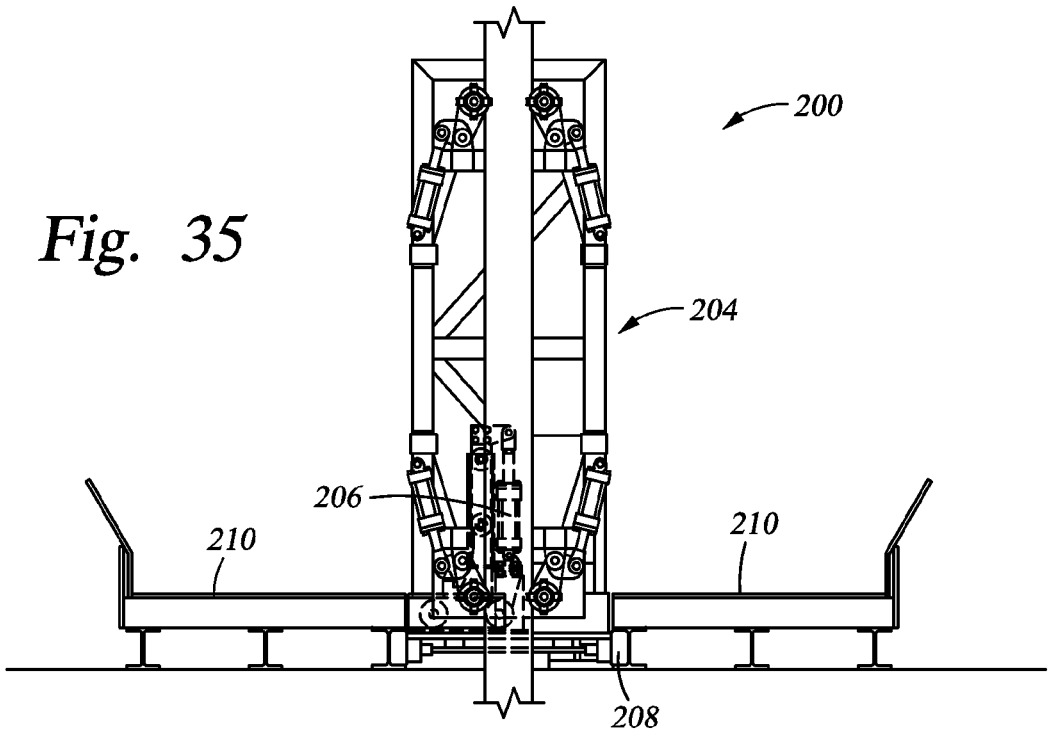
FIGS. 35-40 illustrate a setback handling system constructed in accordance with further embodiments of the present invention.
Figure 36:
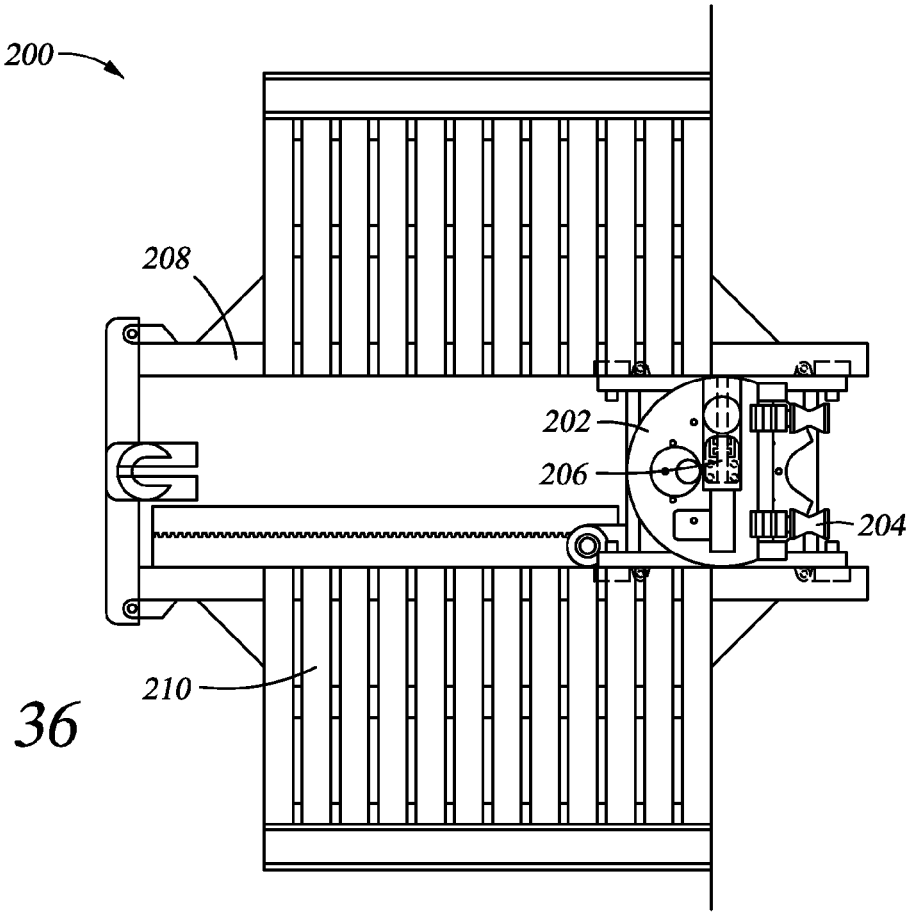
Figure 37:
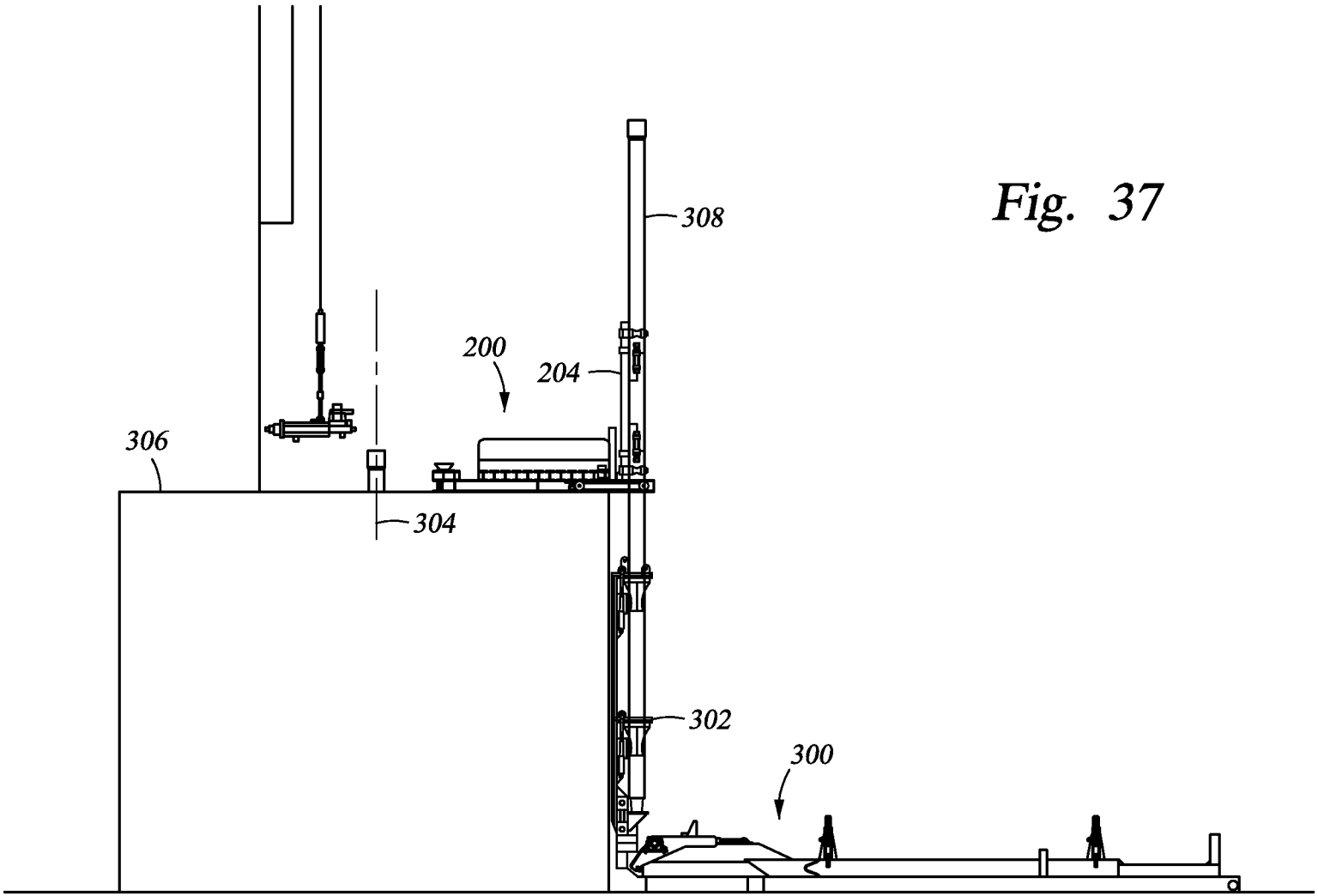
Figure 38:
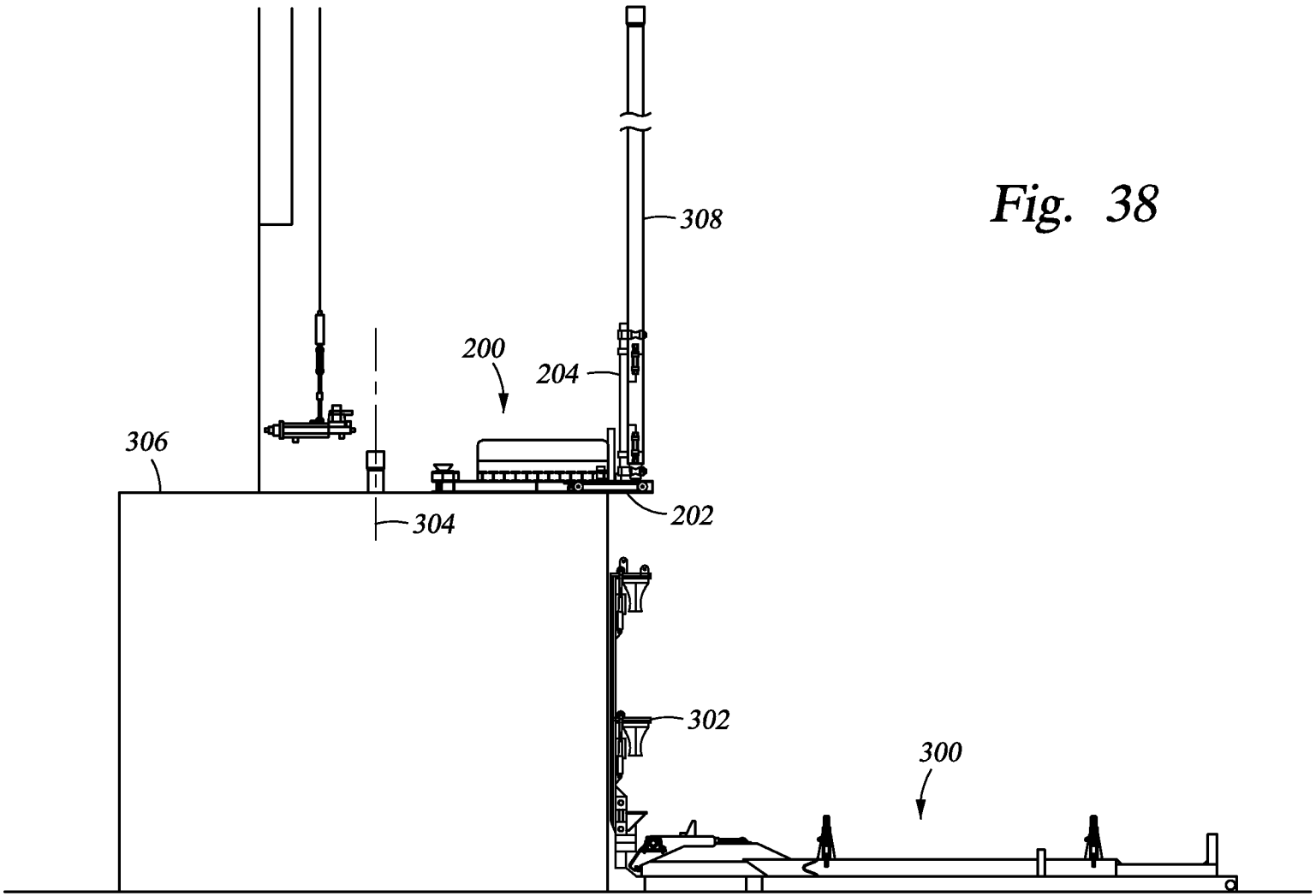
Figure 39:
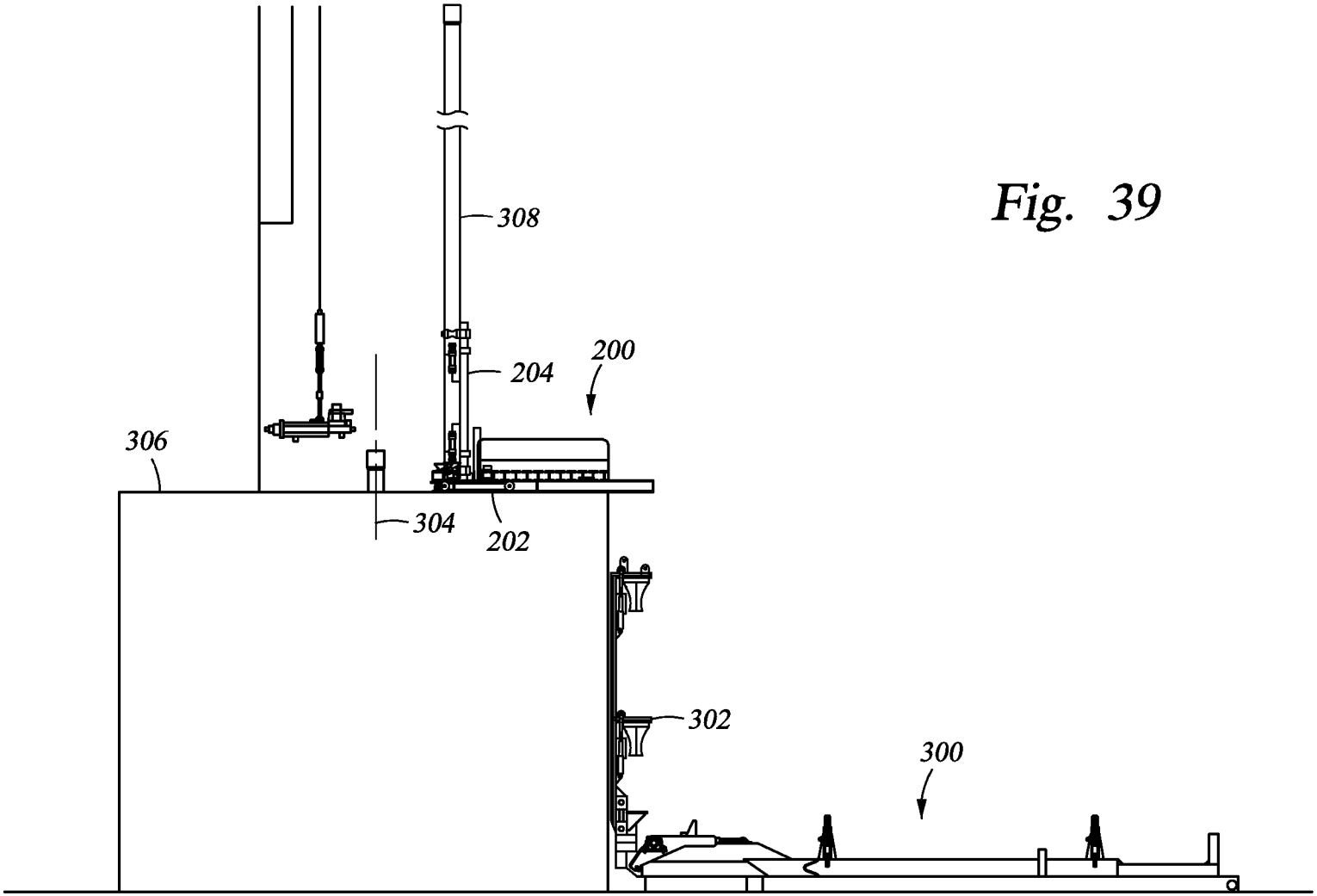
Figure 40:
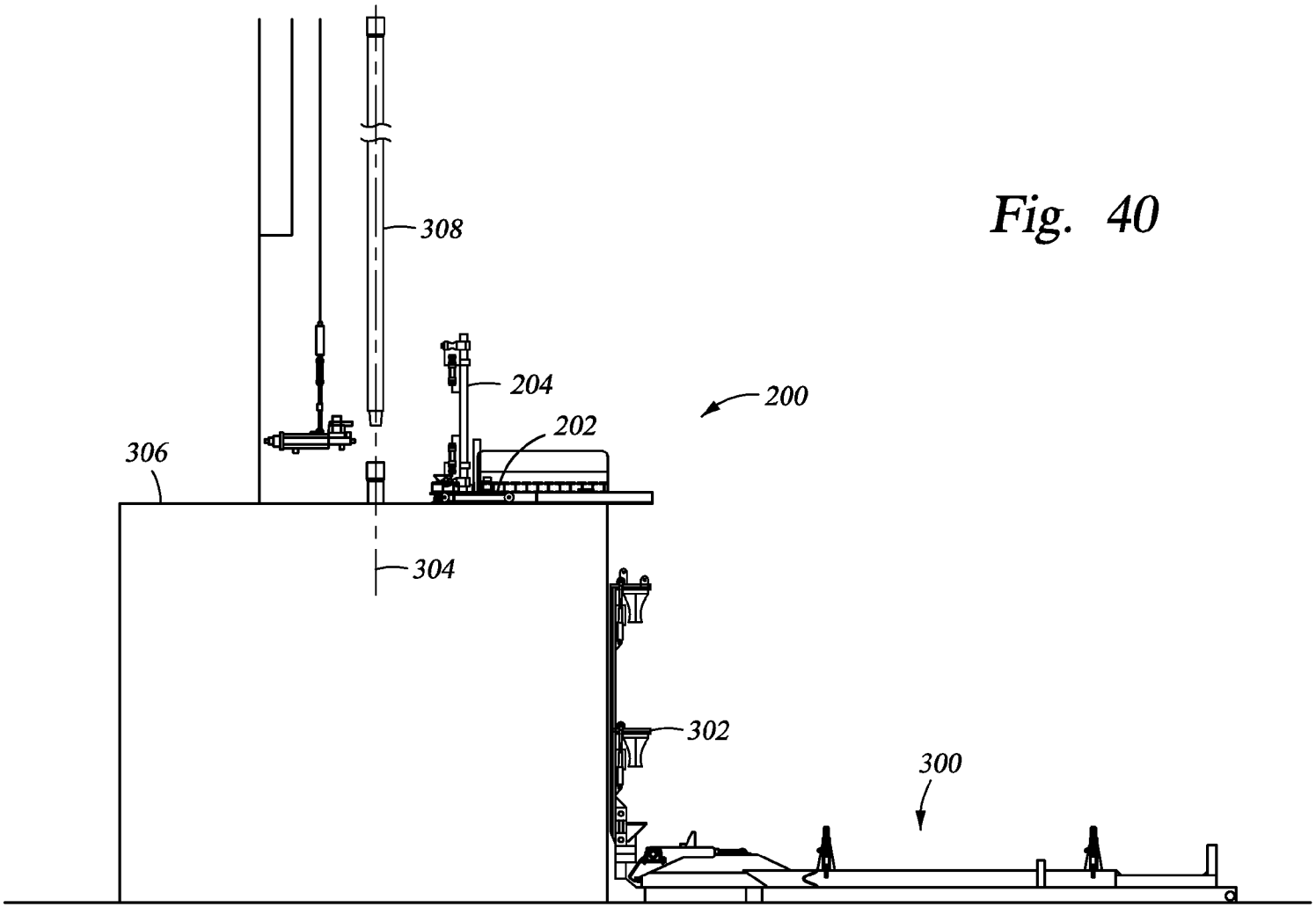

FIGS. 35 and 36 illustrate an embodiment of a setback handling system 200 comprising rotating table 202, pipe guide 204, and pipe mover 206. Table 202 is slidably mounted on rails 208 that extend through storage beams 210. FIGS. 37-40 illustrate the use of setback handling system 200 in the moving of tubular member 308 from pipe erector 300 to well center 304. Tubular member 308 is moved from a horizontal storage position to a vertical position by pipe erector 300 where it is supported by vertical support structure 302 as shown in FIG. 37. Pipe guide 204 engages tubular member 308 as it is raised above drill floor 306, as shown in FIG. 38. Referring now to FIGS. 39 and 40, table 202 rotates and moves toward well center 304 so that tubular member 308 can be picked up and moved to the well center 304 by the elevator (not shown).

It is understood that the embodiments of the pipe handling and racking systems described herein can be used with a variety of oilfield tubulars, including drill pipe, drill collars, casing, and tubing. Other tubulars are also included, and reference to drill pipe is intended to encompass these oilfield tubulars. Likewise, a drilling mast may also refer to other drilling structures extending above a drill floor to support equipment for downhole operations.

Various disclosed embodiments include a pipe racking system having a modular frame and extendable arm assembly for connection to a drilling mast. The assembly includes a grip jaw that can be manipulated to move a drill pipe from a drill string to a stored position and vice versa. The manipulation includes at least vertical and rotational movement of any one or all of the arm, grip jaw and drill pipe. Horizontal movements may also be used. Certain embodiments include a setback handling system in the setback area for handling the lower end of the drill pipe. The setback handling system can be used to manipulate the lower end of the drill pipe for make up with a drill string, or for movement to storage positions in the setback area. The setback handling system may include various combinations of a pipe guide, a pipe mover, and a slidable and rotatable table each having actuators for automated movement, along with a setback rack having storage slots for the drill pipe. Some embodiments also include a pipe erector and vertical support structure. In some of the disclosed embodiments, the movements and manipulations of the drill pipe from the drill string to a storage position or vice versa are achieved by using structures that move relative to each other via actuators, such as control cylinders, such that rig personnel is not needed. The reduction or elimination of rig personnel involvement may also be known as being "automated" or "automatic."

While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

What is claimed is:

1. A pipe handling system comprising:

a pipe racker to engage an upper end of a drill pipe; and a setback handling system disposed on the drill floor below the pipe racker to engage a lower end of the drill pipe, the setback handling system comprising:

a rotatable table supporting a moveable pipe guide configured to receive the lower end of the drill pipe;

a sled disposed on the rotatable table; and a push or pull mechanism coupled to the sled and configured to extend the sled and the drill pipe supported thereon into a setback rack independently of the pipe guide;

wherein the push or pull mechanism comprises an actuator coupled to the sled, wherein the actuator is configured to be disposed completely between two beams of a slot in the setback rack.

2. The pipe handling system of claim 1 wherein the pipe guide is configured to move the lower end of the drill pipe toward a well center.

3. The pipe handling system of claim 1 wherein the rotatable table is slidably disposed on tracks.

4. The pipe handling system of claim 1 wherein the pipe guide is aligned at a different rotational position relative to the sled on the rotatable table, and the table is rotatable to place each of the pipe guide and the sled in a range of different rotational positions.

5. The pipe handling system of claim 1 wherein the pipe guide includes rollers configured to moveably engage the lower end of the drill pipe.

6. The pipe handling system of claim 1 wherein the sled supports a drill pipe engagement finger and a lift cylinder configured to engage and move the drill pipe independently of the pipe guide.

7. The pipe handling system of claim 6 wherein the sled is slidably coupled to the rotatable table such that the sled is horizontally moveable by the push or pull mechanism, and the table is rotatable to place the sled at different rotational positions.

8. The pipe handling system of claim 6 wherein the drill pipe engagement finger is configured to engage an inner portion of the drill pipe.

9. The pipe handling system of claim 1 wherein the pipe racker includes a frame removably coupled to a drilling mast and an articulated gripping arm operable to engage and move the upper end of the drill pipe.

10. The pipe handling system of claim 9 further comprising:

a grip jaw extending from the gripping arm to engage the drill pipe;

wherein the gripping arm and the grip jaw are operable to move the drill pipe from within the drilling mast to a pipe storage area adjacent the drilling mast.

11. The pipe handling system of claim 10 further comprising:

a carriage pivotally and slidably coupled to a track on the frame; and a column extending down from the carriage and coupled to the gripping arm.

12. The pipe handling system of claim 11 wherein:

the column includes a vertically moveable post and a rotation mechanism to rotate the post and the gripping arm; and the gripping arm is operable to move the grip jaw horizontally.

13. The pipe handling system of claim 12 further comprising:

a first control cylinder coupled to the carriage to control the slidable movement of the carriage;

a second control cylinder coupled to the post to control the vertical movement of the post; and a third control cylinder to control the extension and retraction of the articulated gripping arm.

14. The pipe handling system of claim 1 wherein the actuator comprises a push-pull chain.

15. The pipe handling system of claim 1 wherein the setback rack comprises a plurality of beams forming slots, and wherein the sled comprises wheels supported directly on at least one of the beams.

* * * * *